US007254976B2

(12) United States Patent
Takashima et al.

(10) Patent No.: US 7,254,976 B2
(45) Date of Patent: Aug. 14, 2007

(54) METHOD OF MANUFACTURING LIQUID EJECTION HEAD

(75) Inventors: Nagamitsu Takashima, Nagano (JP); Ryoji Uesugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 381 days.

(21) Appl. No.: 10/913,513

(22) Filed: Aug. 9, 2004

(65) Prior Publication Data

US 2005/0057614 A1 Mar. 17, 2005

(30) Foreign Application Priority Data

Aug. 12, 2003 (JP) ..... P2003-292466

(51) Int. Cl.
*B21D 17/02* (2006.01)
*B41J 2/045* (2006.01)

(52) U.S. Cl. ..... 72/335; 29/890.1

(58) Field of Classification Search ..... 72/335, 72/325, 330, 331, 379.2; 29/890.1, 890.142, 29/890.143; 347/71
See application file for complete search history.

(56) References Cited

U.S. PATENT DOCUMENTS 4,403,494 A * 9/1983 McCullough ..... 72/360
5,458,158 A * 10/1995 Kawanabe ..... 140/105
6,082,001 A * 7/2000 Bettelini ..... 29/893.33
6,189,363 B1 * 2/2001 Lai ..... 72/358
6,499,836 B1 * 12/2002 Usui et al. ..... 347/70
6,968,616 B2 * 11/2005 Nakamura et al. ..... 29/890.1

FOREIGN PATENT DOCUMENTS

JP 63-207435 * 8/1988
JP 4-59146 * 2/1992
JP 2000-263799 A 9/2000

* cited by examiner

*Primary Examiner*—Daniel C. Crane
(74) *Attorney, Agent, or Firm*—Sughrue Mion, PLLC

(57) ABSTRACT

There is provided a first die in which a plurality of projections are arrayed in a first direction with a fixed pitch. Each projection is elongated in a second direction perpendicular to the first direction. The first die faces a first face of a plate member. A second die is opposed to the first die while supporting a second face of the plate member. At least one dam member is provided in at least one of the first die and the second die, so as to project from one of the first die and the second die toward the other. The first and second dies are approached so that the dam member is dug into at least one of the first face and the second face. The first and second dies are further approached so that the projections are dug into a first region in the first face, thereby forming partitioned recesses to be pressure generating chambers of a liquid ejection head. The dam member is situated in the vicinity of at least one of ends in the first direction of the first region, thereby suppressing a plastic flow of the material in the first direction caused by the dug projections.

9 Claims, 16 Drawing Sheets

METHOD OF MANUFACTURING LIQUID EJECTION HEAD

BACKGROUND OF THE INVENTION

The present invention relates to a liquid ejection head and a method of manufacturing the same.

The liquid ejection head ejects pressurized liquid from a nozzle orifice as a liquid droplet, and the heads for various liquids have been known. An ink jet recording head is representative of the liquid ejection head. Here, the related art will be described with the ink jet recording head as an example.

An ink jet recording head (hereinafter, referred to as "recording head") used as an example of a liquid ejection head is provided with a plurality of series of flow paths reaching nozzle orifices from a common ink reservoir via pressure generating chambers in correspondence with the orifices. Further, the respective pressure generating chambers need to form by a fine pitch in correspondence with a recording density to meet a request of downsizing. Therefore, a wall thickness of a partition wall for partitioning contiguous ones of the pressure generating chambers is extremely thinned. Further, an ink supply port for communicating the pressure generating chamber and the common ink reservoir is more narrowed than the pressure generating chamber in a flow path width thereof in order to use ink pressure at inside of the pressure generating chamber efficiently for ejection of ink drops.

To form the pressure generating chambers and the ink supply ports having such minute structures with high dimensional accuracy, very fine forging work is performed on a metal material plate (see Japanese Patent Publication No. 2000-263799A, for example).

As shown in FIG. 20, the pressure generating chambers are produced by forming a large number of elongated recess portions 71 in a metal material plate 70. The elongated recess portions 71 are formed by pressing the material plate 70 between dies, that is, a first die 72 and a second die 73. In the first die 72, a large number of projections 74 for formation of the elongated recess portions 71 are arrayed parallel with each other and gap portions 76 for formation of partition walls 75 of the pressure generating chambers are provided between the projections 74.

FIG. 20 shows a state that the material plate 70 is pressed by the first die 72 and the second die 73. When the projections 74 of the first die 72 are dug into the material plate 70, the material close to array-end projections 74 flows plastically in a direction indicated by arrows 77. As this plastic flow occurs, forces of pushing the tip ends of the array-end projections 74 in the arrayed direction thereof act on those projections 74 as indicated by arrows 78. When such forces are applied, stress is concentrated on the base portion of each projection 74 and cracks 79 may develop, possibly breaking a projection 74. Cracks 79 may develop in a relatively small number of projections 74 close to the end of the array of projections 74.

When cracks 79 develop or a projection 74 is broken, the elongated recess portions 71 are not formed in a prescribed shape. Since the life of the dies is shortened, the dies need to be replaced frequently, which is uneconomical in terms of the equipment costs. Another problem is that die replacement work lowers the productivity.

SUMMARY OF THE INVENTION

It is an object of the invention to manufacture a liquid ejection head with uniform accuracy while suppressing a plastic flow occurring in a material plate, thereby elongate the life of dies.

In order to achieve the above object, according to the invention, there is provided a method of manufacturing a liquid ejection head which ejects liquid droplets from nozzle orifices by generating pressure fluctuation in liquid contained in a plurality of pressure generating chambers communicated with the nozzle orifices, comprising steps of:

providing a metallic plate member;

providing a first die, in which a plurality of projections are arrayed in a first direction with a fixed pitch, each of the projections being elongated in a second direction perpendicular to the first direction, the first die facing a first face of the plate member;

providing a second die, opposed to the first die while supporting a second face of the plate member;

providing at least one dam member in at least one of the first die and the second die, so as to project from one of the first die and the second die toward the other one of the first die and the second die;

approaching the first die and the second die, so that the at least one dam member is dug into at least one of the first face and the second face of the plate member; and further approaching the first die and the second die, so that the projections are dug into a first region in the first face of the plate member, the projections being pressed in a third direction orthogonal to the first direction and the second direction, so as to generate a plastic flow of a material in the plate member into gaps defined between the projections, thereby forming partitioned recesses to be the pressure generating chambers, wherein the at least one dam member is situated in the vicinity of at least one of ends in the first direction of the first region, thereby suppressing a plastic flow of the material in the first direction caused by the dug projections.

With this configuration, as the first die and the second die approach each other, at least one of the dam member of the first die or the dam member of the second die is first moved to the position where to stop a material flow in the plate member, whereby a state of stopping (damming up) a plastic flow in the arrayed direction of projections is established. After then, the projections are dug into the plate member and the partitioned recesses are formed. Therefore, even if the material receives force that causes it to flow in the arrayed direction of the projections due to the digging of the projections, the dam member prevents the material from flowing plastically. The disadvantageous forces (indicated by arrows 78 in FIG. 20) does not act on projections and no stress is concentrated on the base portions of the projections.

Preferably, the dam member is elongated in the second direction, and a tip end of the dam member is closer to the plate member than tip ends of the projections.

Preferably, the at least one dam member is provided in each of the first die and the second die, such that the dam member in the first die and the dam member in the second die are opposed to each other.

With this configuration, the space through which the stopped material is partially allowed to flow plastically is narrowed by the opposed dam members, which makes the suppressive function more reliable.

Preferably, the plate member includes at least one opening formed in at least one of the first face and the second face and configured to accept the dam member.

With this configuration, the opening greatly reduces reaction forces that are produced when the dam member is dug into the plate member. This makes it possible to easily have the dam member located at the prescribed positions and to reliably allow the dam member to stand by there for digging of the projections. Further, the opening also serves as a positioning member for the dam member.

Here, it is preferable that the opening is formed in each of the first face and the second face. More preferably, the opening formed in the first face is communicated with the opening formed in the second face.

With this configuration, the reaction forces can be made substantially zero, whereby the dam member is reliably allowed to stand by for digging of the projections.

It is also preferable that each of the opening formed in the first face and the opening formed in the second face is a bottomed hole. More preferably, the dam member is dug into a bottom portion of the bottomed hole.

The manufacturing method further comprises a step of punching a through hole at a bottom of each of the partitioned recesses, the through hole being to be a passage communicating one of the pressure chambers and one of the nozzle orifice.

With this configuration, the material does not exert pressing forces on projections in the arrayed direction thereof, and hence the partitioned recesses formed suffer from no such errors as inclinations from the depth direction thereof. Since the punches are inserted into those high-accuracy recesses, the punches do not interfere with the inner surfaces of the recesses and passages are formed at the correct positions with respect to the recesses. Ink flows smoothly as intended and stagnation of bubbles can be prevented.

According to the invention, there is also provided a liquid ejection head, comprising:

a metallic plate member, comprising:

a first face, having a first region formed with a plurality of recesses which are arrayed in a first direction, each of the recesses being elongated in a second direction perpendicular to the first direction; and a second face, formed with a plurality of holes each of which is communicated with one of the recesses;

an elastic plate, joined to the first face of the plate member so as to seal the recesses to form the pressure generating chamber; and a nozzle plate, joined to the second face of the plate member, the nozzle plate formed with a plurality of nozzle orifices from which the liquid droplets are ejected, each of the nozzle orifice being communicated with one of the holes, wherein at least one opening elongated in the second direction is formed in at least one of the first face and the second face of the plate member so as to situate in the vicinity of at least one of ends in the first direction of the first region.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below with reference to the accompanying drawings. Firstly, the constitution of a liquid ejection head will be described.

Since it is preferable to apply the invention to a recording head of an ink jet recording apparatus, as an example representative of the liquid ejection head, the above recording head is shown in the embodiment.

Figure 1:
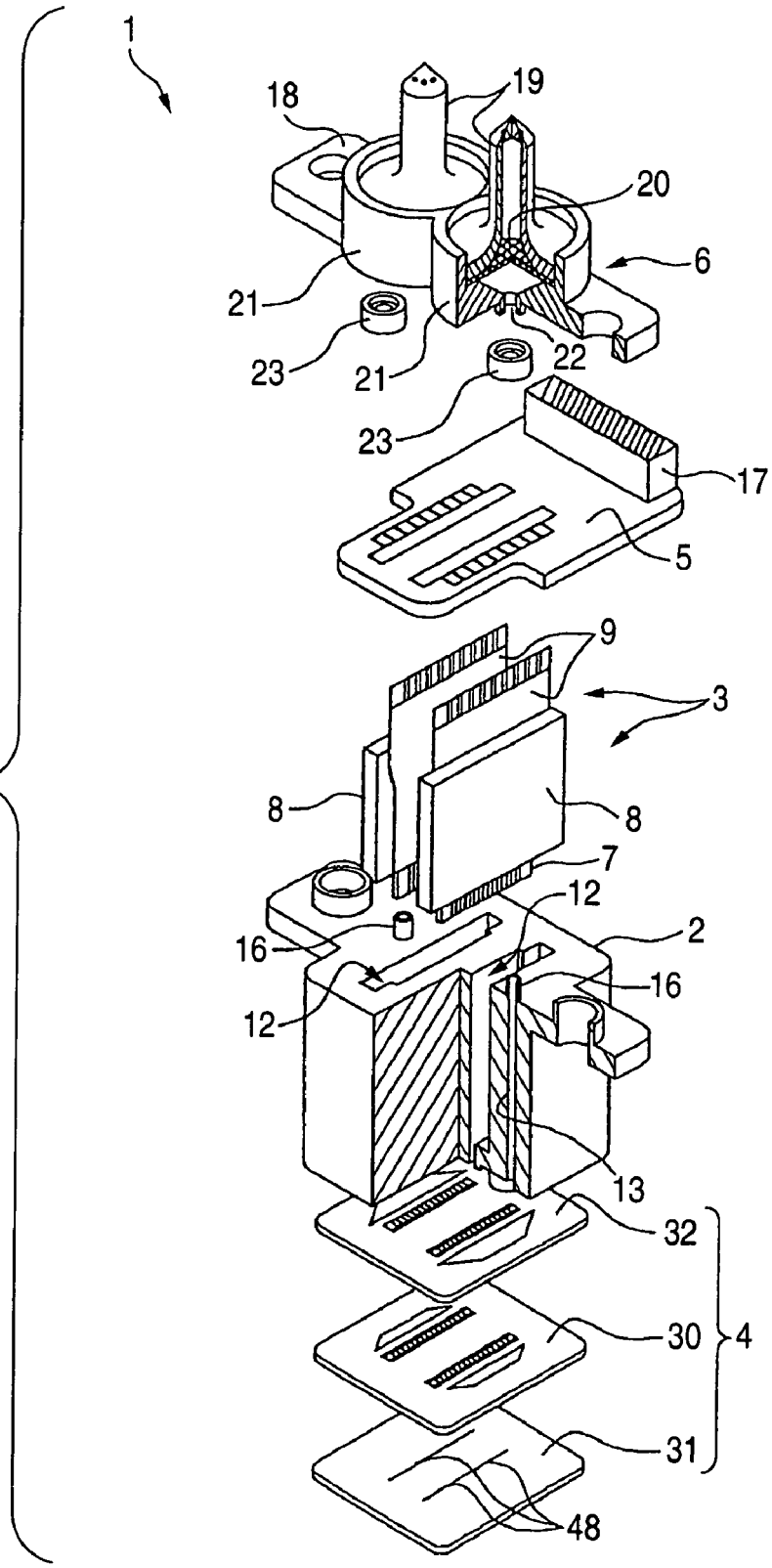
FIG. 1 is a perspective view of a disassembled ink jet recording head according to a first embodiment of the invention.
Figure 2:
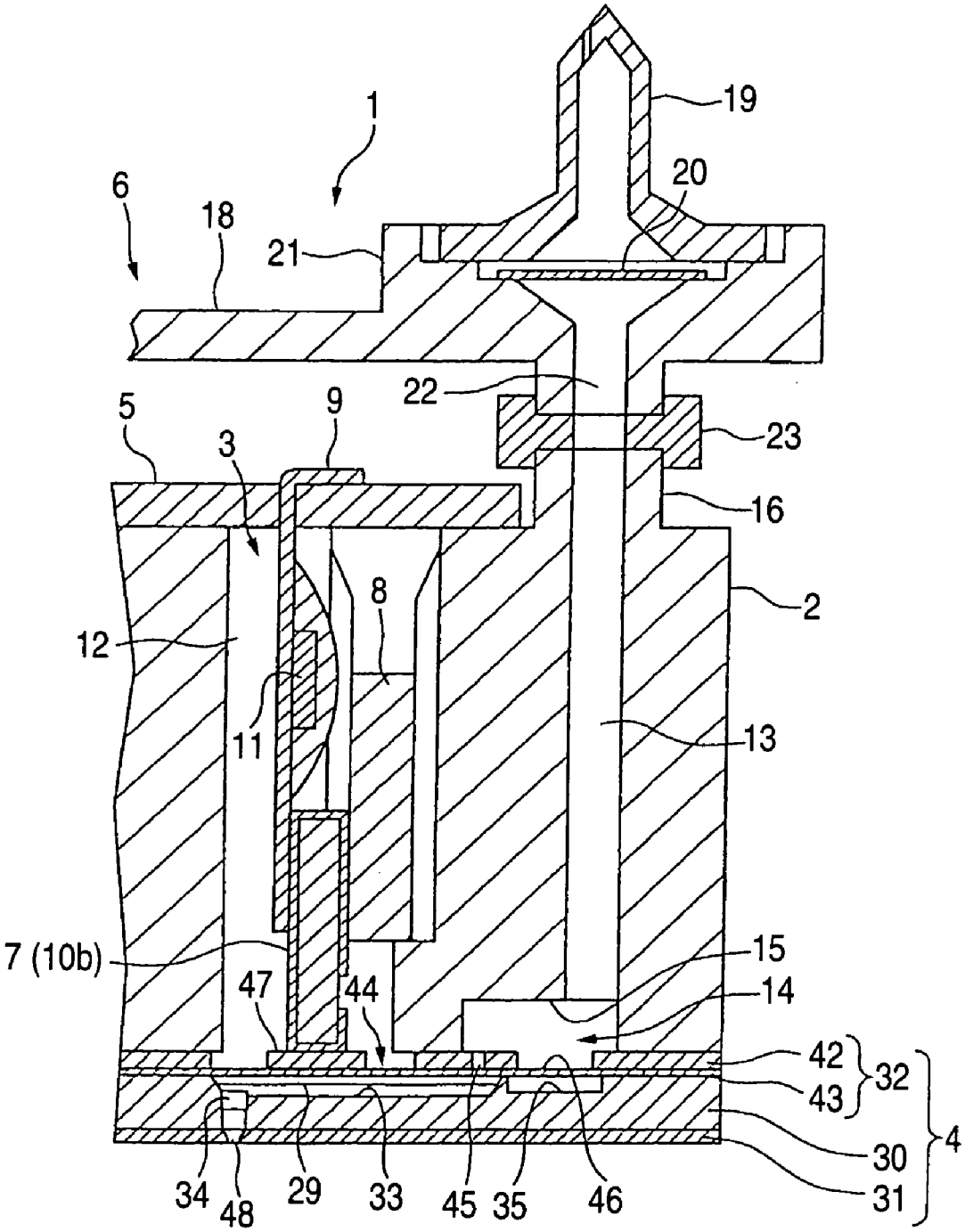
FIG. 2 is a sectional view of the ink jet recording head.

As shown in FIGS. 1 and 2, a recording head 1 is roughly constituted by a casing 2, a vibrator unit 3 contained at inside of the casing 2, a flow path unit 4 bonded to a front end face of the casing 2, a connection board 5 arranged onto a rear end face of the casing 2, a supply needle unit 6 attached to the rear end face of the casing 2.

Figure 3A:
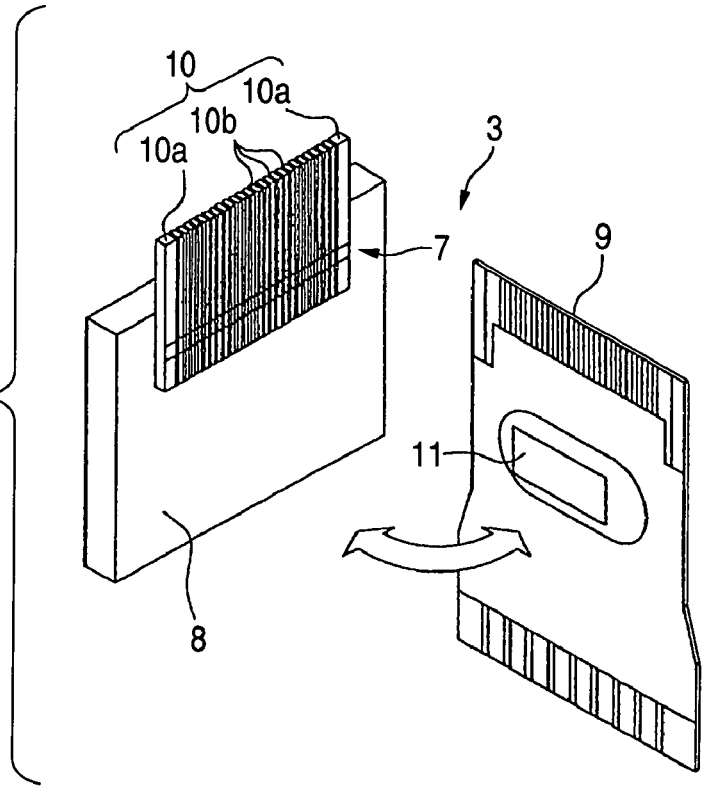
FIGS. 3A and 3B are views for explaining a vibrator unit.
Figure 3B:
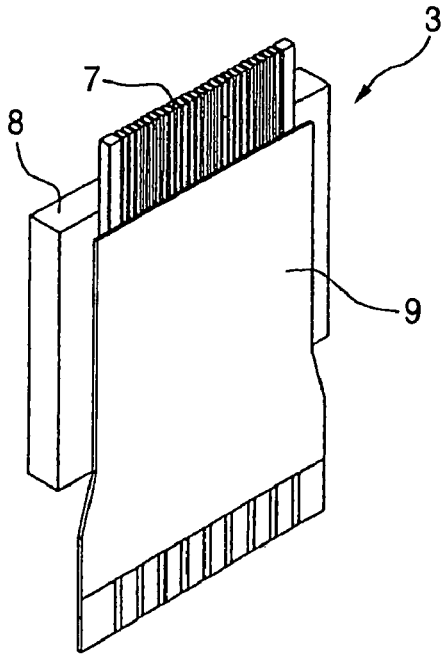

As shown in FIGS. 3A and 3B, the vibrator unit 3 is roughly constituted by a piezoelectric vibrator group 7, a fixation plate 8 bonded with the piezoelectric vibrator group 7 and a flexible cable 9 for supplying a drive signal to the piezoelectric vibrator group 7.

The piezoelectric vibrator group 7 is provided with a plurality of piezoelectric vibrators 10 formed in a shape of a row. The respective piezoelectric vibrators 10 are constituted by a pair of dummy vibrators 10*a* disposed at both ends of the row and a plurality of drive vibrators 10*b* arranged between the dummy vibrators 10*a*. Further, the respective drive vibrators 10*b* are cut to divide in a pectinated shape having an extremely slender width of, for example, about 50 μm through 100 μm, so that 180 pieces are provided.

Further, the dummy vibrator 10*a* is provided with a width sufficiently wider than that of the drive vibrator 10*b* and is provided with a function for protecting the drive vibrator 10*b* against impact or the like and a guiding function for positioning the vibrator unit 3 at a predetermined position.

A free end portion of each of the piezoelectric vibrators 10 is projected to an outer side of a front end face of the fixation plate 8 by bonding a fixed end portion thereof onto the fixation plate 8. That is, each of the piezoelectric vibrators 10 is supported on the fixation plate 8 in a cantilevered manner. Further, the free end portions of the respective piezoelectric vibrators 10 are constituted by alternately laminating piezoelectric bodies and inner electrodes so that extended and contracted in a longitudinal direction of the elements by applying a potential difference between the electrodes opposed to each other.

The flexible cable 9 is electrically connected to the piezoelectric vibrator 10 at a side face of a fixed end portion thereof constituting a side opposed to the fixation plate 8. Further, a surface of the flexible cable 9 is mounted with an IC 11 for controlling to drive the piezoelectric vibrator 10 or the like. Further, the fixation plate 8 for supporting the respective piezoelectric vibrators 10 is a plate-shaped member having a rigidity capable of receiving reaction force from the piezoelectric vibrators 10, and a metal plate of a stainless steel plate or the like is preferably used therefor.

The casing 2 is a block-shaped member molded by a thermosetting resin of an epoxy species resin or the like. Here, the casing 2 is molded by the thermosetting resin because the thermosetting resin is provided with a mechanical strength higher than that of a normal resin, a linear expansion coefficient is smaller than that of a normal resin so that deformability depending on the environmental temperature is small. Further, inside of the casing 2 is formed with a container chamber 12 capable of containing the vibrator unit 3, and an ink supply path 13 constituting a portion of a flow path of ink. Further, the front end face of the casing 2 is formed with a recess 15 for constituting a common ink reservoir 14.

The container chamber 12 is a hollow portion having a size of capable of containing the vibrator unit 3. At a portion of a front end side of the container chamber 12, a step portion is formed such that a front end face of the fixation plate 8 is brought into contact therewith.

The recess 15 is formed by partially recessing the front end face of the casing 2 so has to have a substantially trapezoidal shape formed at left and right outer sides of the container chamber 12.

The ink supply path 13 is formed to penetrate the casing 2 in a height direction thereof so that a front end thereof communicates with the recess 15. Further, a rear end portion of the ink supply path 13 is formed at inside of a connecting port 16 projected from the rear end face of the casing 2.

The connection board 5 is a wiring board formed with electric wirings for various signals supplied to the recording head 1 and provided with a connector 17 capable of connecting a signal cable. Further, the connection board 5 is arranged on the rear end face of the casing 2 and connected with electric wirings of the flexible cable 9 by soldering or the like. Further, the connector 17 is inserted with a front end of a signal cable from a control apparatus (not illustrated).

The supply needle unit 6 is a portion connected with an ink cartridge (not illustrated) and is roughly constituted by a needle holder 18, an ink supply needle 19 and a filter 20.

The ink supply needle 19 is a portion inserted into the ink cartridge for introducing ink stored in the ink cartridge. A distal end portion of the ink supply needle 19 is sharpened in a conical shape to facilitate to insert into the ink cartridge. Further, the distal end portion is bored with a plurality of ink introducing holes for communicating inside and outside of the ink supply needle 19. Further, since the recording head according to the embodiment can eject two kinds of inks, two pieces of the ink supply needles 19 are provided.

The needle holder 18 is a member for attaching the ink supply needle 19, and a surface thereof is formed with base seats 21 for two pieces of the ink supply needles 19 for fixedly attaching proximal portions of the ink supply needles 19. The base seat 21 is fabricated in a circular shape in compliance with a shape of a bottom face of the ink supply needle 19. Further, a substantially central portion of the bottom face of the base seat is formed with an ink discharge port 22 penetrated in a plate thickness direction of the needle holder 18. Further, the needle holder 18 is extended with a flange portion in a side direction.

The filter 20 is a member for hampering foreign matters at inside of ink such as dust, burr in dieing and the like from passing therethrough and is constituted by, for example, a metal net having a fine mesh. The filter 20 is adhered to a filter holding groove formed at inside of the base seat 21.

Further, as shown in FIG. 2, the supply needle unit 6 is arranged on the rear end face of the casing 2. In the arranging state, the ink discharge port 22 of the supply needle unit 6 and the connecting port 16 of the casing 2 are communicated with each other in a liquid tight state via a packing 23.

Next, the above-described flow path unit 4 will be explained. The flow path unit 4 is constructed by a constitution in which a nozzle plate 31 is bonded to one face of a chamber formation plate 30 and an elastic plate 32 is bonded to other face of the chamber formation plate 30.

Figure 4:
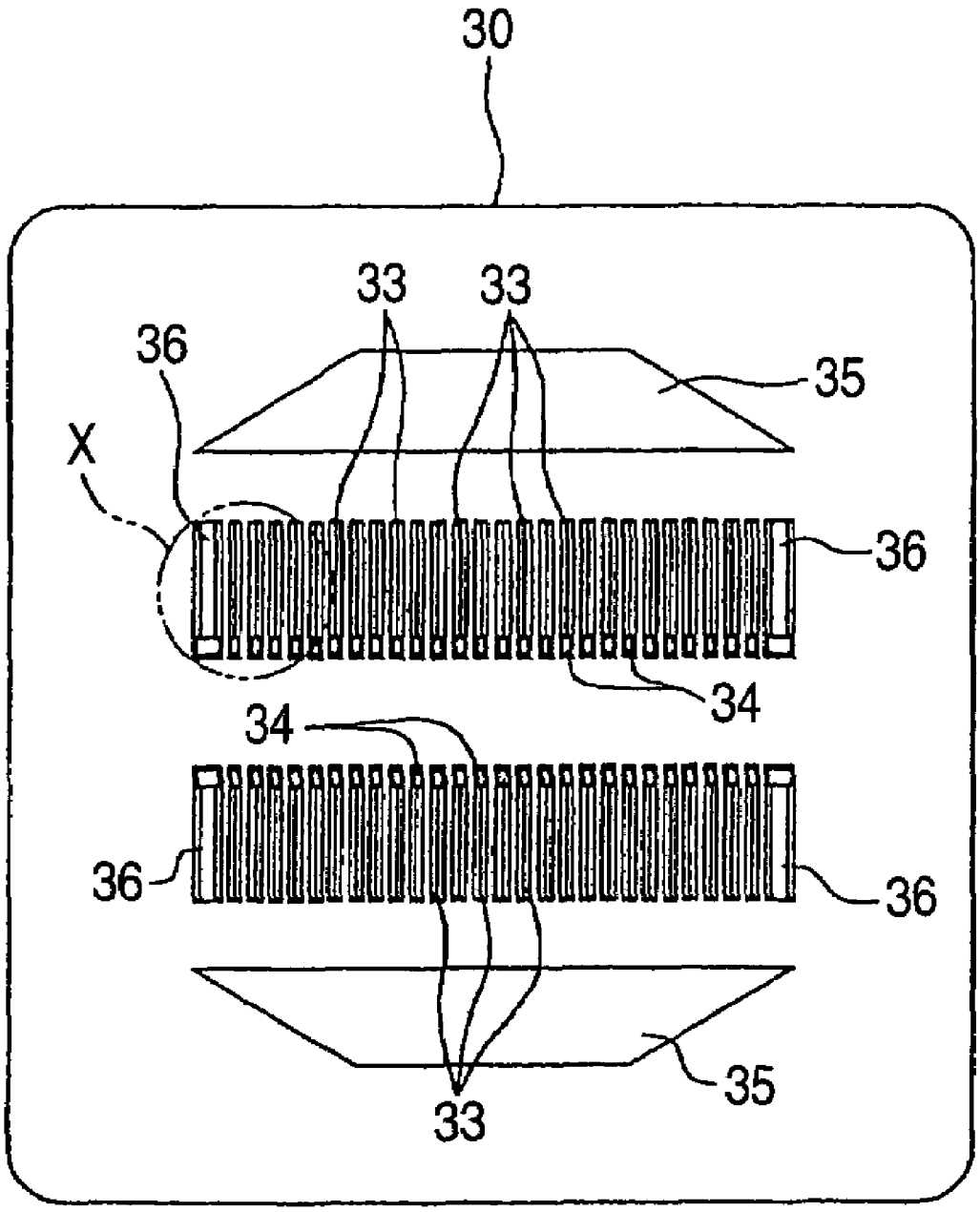
FIG. 4 is a plan view of a chamber formation plate.

As shown in FIG. 4, the chamber formation plate 30 is a plate-shaped member made of a metal formed with an elongated recess portion 33, a communicating port 34 and an escaping recess portion 35. According to the embodiment, the chamber formation plate 30 is fabricated by working a metal substrate made of nickel having a thickness of 0.35 mm.

An explanation will be given here of reason of selecting nickel of the metal substrate. First reason is that the linear expansion coefficient of nickel is substantially equal to a linear expansion coefficient of a metal (stainless steel in the embodiment as mentioned later) constituting essential portions of the nozzle plate 31 and the elastic plate 32. That is, when the linear expansion coefficients of the chamber formation plate 30, the elastic plate 32 and the nozzle plate 31 constituting the flow path unit 4 are substantially equal, in heating and adhering the respective members, the respective members are uniformly expanded.

Therefore, mechanical stress of warping or the like caused by a difference in the expansion rates is difficult to generate. As a result, even when the adhering temperature is set to high temperature, the respective members can be adhered to each other without trouble. Further, even when the piezoelectric vibrator 10 generates heat in operating the recording head 1 and the flow path unit 4 is heated by the heat, the respective members 30, 31 and 32 constituting the flow path unit 4 are uniformly expanded. Therefore, even when heating accompanied by activating the recording head 1 and cooling accompanied by deactivating are repeatedly carried out, a drawback of exfoliation or the like is difficult to be brought about in the respective members 30, 31 and 32 constituting the flow path unit 4.

Second reason is that nickel is excellent in corrosion resistance. That is, aqueous ink is preferably used in the recording head 1 of this kind, it is important that alteration of rust or the like is not brought about even when the recording head 1 is brought into contact with water over a long time period. In this respect, nickel is excellent in corrosion resistance similar to stainless steel and alteration of rust or the like is difficult to be brought about.

Third reason is that nickel is rich in ductility. That is, in manufacturing the chamber formation plate 30, as mentioned later, the fabrication is carried out by plastic working (for example, forging). Further, the elongated recess portion 33 and the communicating port 34 formed in the chamber formation plate 30 are of extremely small shapes and high dimensional accuracy is requested therefor. When nickel is used for the metal substrate, since nickel is rich in ductility, the elongated recess portion 33 and the communicating port 34 can be formed with high dimensional accuracy even by plastic working.

Further, with regard to the chamber formation plate 30, the chamber formation plate 30 may be constituted by a metal other than nickel when the condition of the linear expansion coefficient, the condition of the corrosion resistance and the condition of the ductility are satisfied.

Figure 5A:
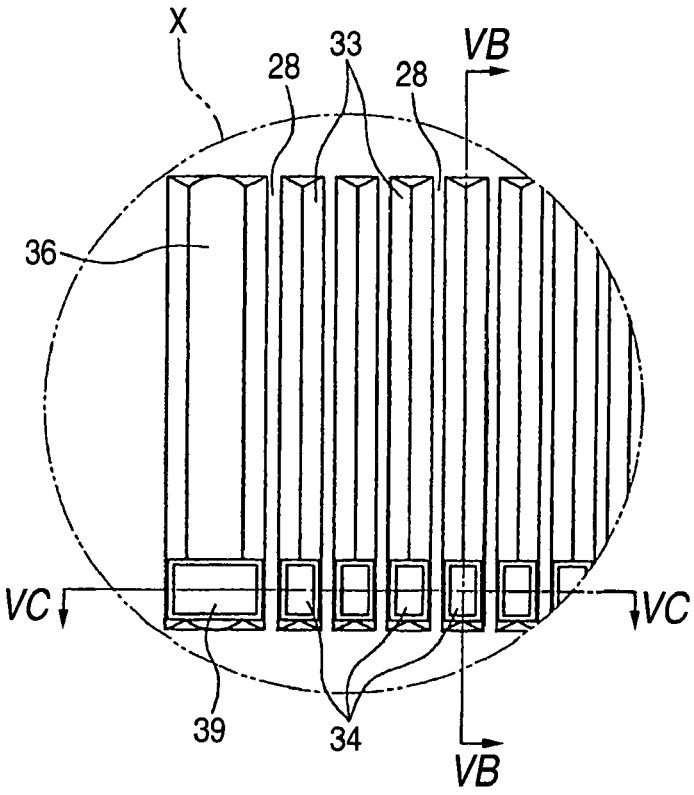
FIG. 5A is a view enlarging an X portion in FIG. 4.

The elongated recess portion 33 is a recess portion in a groove-shaped shape constituting a pressure generating chamber 29 and is constituted by a groove in a linear shape as shown to enlarge in FIG. 5A. According to the embodiment, 180 pieces of grooves each having a width of about 0.1 mm, a length of about 1.5 mm and a depth of about 0.1 mm are aligned side by side. A bottom face of the elongated recess portion 33 is recessed in a V-shaped shape by reducing a width thereof as progressing in a depth direction (that is, depth side). The bottom face is recessed in the V-shaped shape to increase a rigidity of a partition wall 28 for partitioning the contiguous pressure generating chambers 29. That is, by recessing the bottom face in the V-shaped shape, a wall thickness of the proximal portion of the partition wall 28 is thickened to increase the rigidity of the partition wall 28. Further, when the rigidity of the partition wall 28 is increased, influence of pressure variation from the contiguous pressure generating chamber 29 is difficult to be effected. That is, a variation of ink pressure from the contiguous pressure generating chamber 29 is difficult to transmit. Further, by recessing the bottom face in the V-shaped shape, the elongated recess portion 33 can be formed with excellent dimensional accuracy by plastic working (to be mentioned later). Further, an angle between the inner faces of the recess portion 33 is, for example, around 90 degrees although prescribed by a working condition.

Further, since a wall thickness of a distal end portion of the partitioning wall 28 is extremely thin, even when the respective pressure generating chambers 29 are densely formed, a necessary volume can be ensured.

Both longitudinal end portions of the elongated recess portion 33 are sloped downwardly to inner sides as progressing to the depth side. The both end portions are constituted in this way to form the elongated recess portion 33 with excellent dimensional accuracy by plastic working.

Further, contiguous to the elongated recess portion 33 at the both ends of the row, there are formed single ones of dummy recesses 36 having a width wider than that of the elongated recess portion 33. The dummy recess portion 36 is a recess portion in a groove-shaped shape constituting a dummy pressure generating chamber which is not related to ejection of ink drops. The dummy recess portion 36 according to the embodiment is constituted by a groove having a width of about 0.2 mm, a length of about 1.5 mm and a depth of about 0.1 mm. Further, a bottom face of the dummy recess portion 36 is recessed in a W-shaped shape. This is also for increasing the rigidity of the partition wall 28 and forming the dummy recess portion 36 with excellent dimensional accuracy by plastic working.

Further, a row of recesses is constituted by the respective elongated recess portions 33 and the pair of dummy recess portions 36. According to the embodiment, two rows of the recesses are formed as shown in FIG. 4.

The communicating port 34 is formed as a small through hole penetrating from one end of the elongated recess portion 33 in a plate thickness direction. The communicating ports 34 are formed for respective ones of the elongated recess portions 33 and are formed by 180 pieces in a single recess portion row. The communicating port 34 of the embodiment is in a rectangular shape in an opening shape thereof and is constituted by a first communicating port 37 formed from a side of the elongated recess portion 33 to a middle in the plate thickness direction in the chamber formation plate 30 and a second communicating port 38 formed from a surface thereof on a side opposed to the elongated recess portion 33 up to a middle in the plate thickness direction.

Further, sectional areas of the first communicating port 37 and the second communicating port 38 differ from each other and an inner dimension of the second communicating port 38 is set to be slightly smaller than an inner dimension of the first communicating port 37. This is caused by manufacturing the communicating port 34 by pressing. The chamber formation plate 30 is fabricated by working a nickel plate having a thickness of 0.35 mm, a length of the communicating port 34 becomes equal to or larger than 0.25 mm even when the depth of the recess portion 33 is subtracted. Further, the width of the communicating port 34 needs to be narrower than the groove width of the elongated recess portion 33, set to be less than 0.1 mm. Therefore, when the communicating port 34 is going to be punched through by a single time of working, a male die (punch) is buckled due to an aspect ratio thereof.

Therefore, in the embodiment, the working is divided into two steps. In the first step, the first communicating port 37 is formed halfway in the plate thickness direction, and in the second step, the second communicating port 38 is formed. The working process of this communicating port 34 will be described later.

Further, the dummy recess portion 36 is formed with a dummy communicating port 39. Similar to the above-described communicating port 34, the dummy communicating port 39 is constituted by a first dummy communicating port 40 and a second dummy communicating port 41 and an inner dimension of the second dummy communicating port 41 is set to be smaller than an inner dimension of the first dummy communicating port 40.

Further, although according to the embodiment, the communicating port 34 and the dummy communicating port 39 opening shapes of which are constituted by small through holes in a rectangular shape are exemplified, the invention is not limited to the shape. For example, the shape may be constituted by a through hole opened in a circular shape or a through hole opened in a polygonal shape.

The escaping recess portion 35 forms an operating space of a compliance portion 46 (described later) in the common ink reservoir 14. According to the embodiment, the escaping recess portion 35 is constituted by a recess portion in a trapezoidal shape having a shape substantially the same as that of the recess 15 of the casing 2 and a depth equal to that of the elongated recess portion 33.

Next, the above-described elastic plate 32 will be explained. The elastic plate 32 is a kind of a sealing plate of the invention and is fabricated by, for example, a composite material having a two-layer structure laminating an elastic film 43 on a support plate 42. According to the embodiment, a stainless steel plate is used as the support plate 42 and PPS (polyphenylene sulphide) is used as the elastic film 43.

Figure 6:
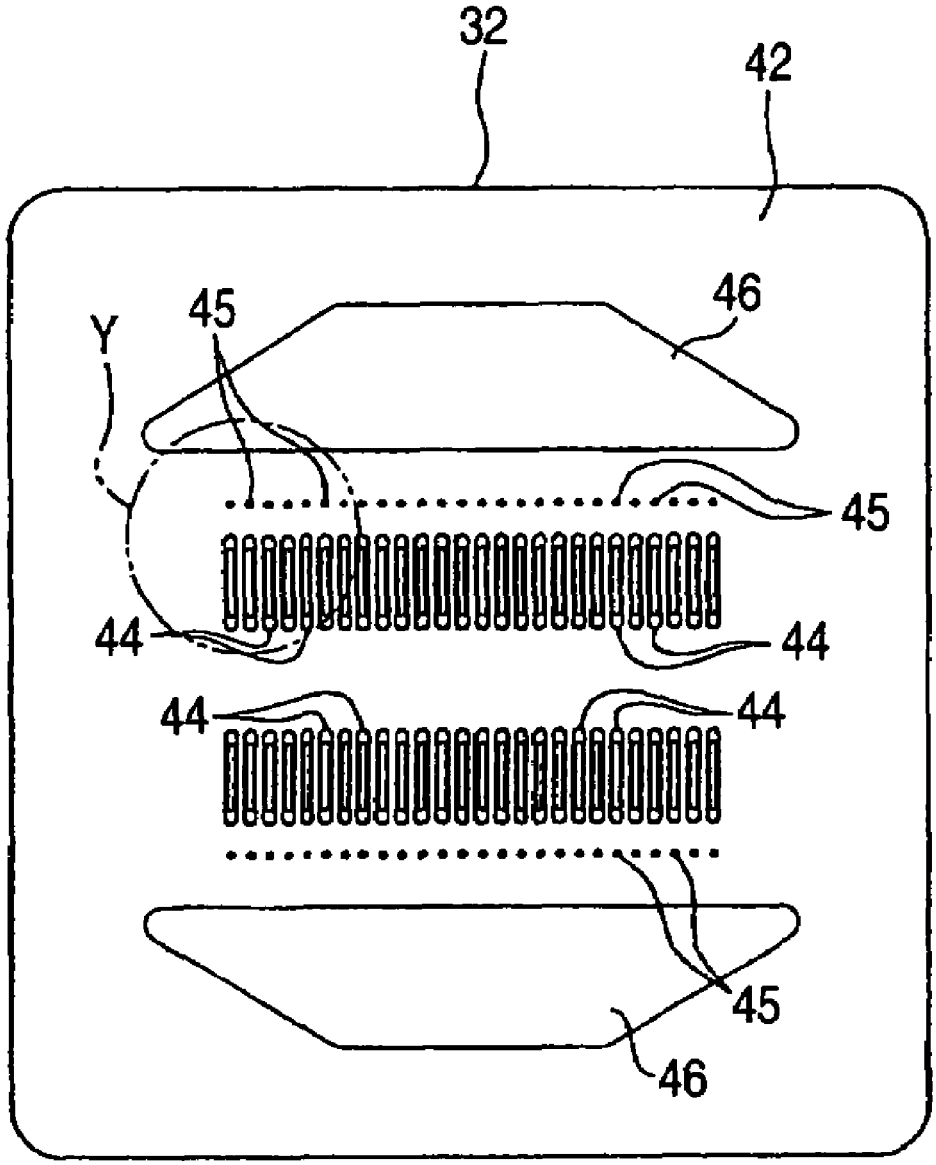
FIG. 6 is a plan view of an elastic plate.

As shown in FIG. 6, the elastic plate 32 is formed with a diaphragm portion 44, an ink supply port 45 and the compliance portion 46.

The diaphragm portion 44 is a portion for partitioning a portion of the pressure generating chamber 29. That is, the diaphragm portion 44 seals an opening face of the elongated recess portion 33 and forms to partition the pressure generating chamber 29 along with the elongated recess portion 33. As shown in FIG. 7A, the diaphragm portion 44 is of a slender shape in correspondence with the elongated recess portion 33 and is formed for each of the elongated recess portions 33 with respect to a sealing region for sealing the elongated recess portion 33. Specifically, a width of the diaphragm portion 44 is set to be substantially equal to the groove width of the elongated recess portion 33 and a length of the diaphragm portion 44 is set to be a slight shorter than the length of the elongated recess portion 33. With regard to the length, the length is set to be about two thirds of the length of the elongated recess portion 33. Further, with regard to a position of forming the diaphragm portion 44, as shown in FIG. 2, one end of the diaphragm portion 44 is aligned to one end of the elongated recess portion 33 (end portion on a side of the communicating port 34).

Figure 7B:
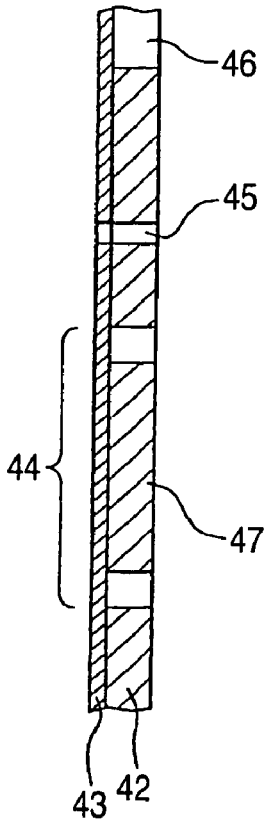
FIG. 7B is a sectional view taken along a line VIIB-VIIB of FIG. 7A.
Figure 7A:
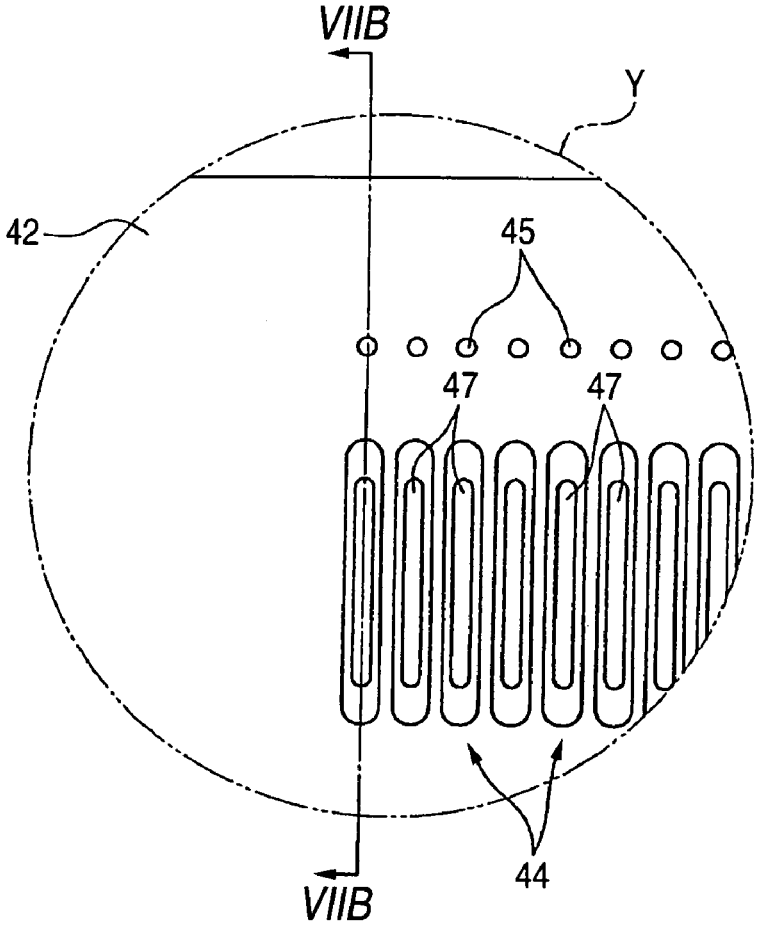
FIG. 7A is a view enlarging a Y portion of FIG. 6.

As shown in FIG. 7B, the diaphragm portion 44 is fabricated by removing the support plate 42 at a portion thereof in correspondence with the elongated recess portion 33 by etching or the like to constitute only the elastic film 43 and an island portion 47 is formed at inside of the ring. The island portion 47 is a portion bonded with a distal end face of the piezoelectric vibrator 10.

The ink supply port 45 is a hole for communicating the pressure generating chamber 29 and the common ink reservoir 14 and is penetrated in a plate thickness direction of the elastic plate 32. Similar to the diaphragm portion 44, also the ink supply port 45 is formed to each of the elongated recess portions 33 at a position in correspondence with the elongated recess portion 33. As shown in FIG. 2, the ink supply port 45 is bored at a position in correspondence with other end of the elongated recess portion 33 on a side opposed to the communicating port 34. Further, a diameter of the ink supply port 45 is set to be sufficiently smaller than the groove width of the elongated recess portion 33. According to the embodiment, the ink supply port 45 is constituted by a small through hole of 23 μm.

Reason of constituting the ink supply port 45 by the small through hole in this way is that flow path resistance is provided between the pressure generating chamber 29 and the common ink reservoir 14. That is, according to the recording head 1, an ink drop is ejected by utilizing a pressure variation applied to ink at inside of the pressure generating chamber 29. Therefore, in order to efficiently eject an ink drop, it is important that ink pressure at inside of the pressure generating chamber 29 is prevented from being escaped to a side of the common ink reservoir 14 as less as possible. From the view point, the ink supply port 45 is constituted by the small through hole.

Further, when the ink supply port 45 is constituted by the through hole as in the embodiment, there is an advantage that the working is facilitated and high dimensional accuracy is achieved. That is, the ink supply port 45 is the through hole, can be fabricated by laser machining. Therefore, even a small diameter can be fabricated with high dimensional accuracy and also the operation is facilitated.

The compliance portion 46 is a portion for partitioning a portion of the common ink reservoir 14. That is, the common ink reservoir 14 is formed to partition by the compliance portion 46 and the recess 15. The compliance portion 46 is of a trapezoidal shape substantially the same as an opening shape of the recess 15 and is fabricated by removing a portion of the support plate 42 by etching or the like to constitute only the elastic film 43.

Further, the support plate 42 and the elastic film 43 constituting the elastic plate 32 are not limited to the example. Further, polyimide may be used as the elastic film 43. Further, the elastic plate 32 may be constituted by a metal plate provided with a thick wall and a thin wall at a surrounding of the thick wall for constituting the diaphragm portion 44 and a thin wall for constituting the compliance portion 46.

Next, the above-described nozzle plate 31 will be explained. The nozzle plate 31 is a plate-shaped member made of a metal aligned with a plurality of nozzle orifices 48 at a pitch in correspondence with a dot forming density. According to the embodiment, a nozzle row is constituted by aligning a total of 180 pieces of the nozzle orifices 48 and two rows of the nozzles are formed as shown in FIG. 2.

Further, when the nozzle plate 31 is bonded to other face of the chamber formation plate 30, that is, to a surface thereof on a side opposed to the elastic plate 32, the respective nozzle orifices 48 face the corresponding communicating ports 34.

Further, when the above-described elastic plate 32 is bonded to one surface of the chamber formation plate 30, that is, a face thereof for forming the elongated recess portion 33, the diaphragm portion 44 seals the opening face of the elongated recess portion 33 to form to partition the pressure generating chamber 29. Similarly, also the opening face of the dummy recess portion 36 is sealed to form to partition the dummy pressure generating chamber. Further, when the above-described nozzle plate 31 is bonded to other surface of the chamber formation plate 30, the nozzle orifice 48 faces the corresponding communicating port 34. When the piezoelectric vibrator 10 bonded to the island portion 47 is extended or contracted under the state, the elastic film 43 at a surrounding of the island portion is deformed and the island portion 47 is pushed to the side of the elongated recess portion 33 or pulled in a direction of separating from the side of the elongated recess portion 33. By deforming the elastic film 43, the pressure generating chamber 29 is expanded or contracted to provide a pressure variation to ink at inside of the pressure generating chamber 29.

When the elastic plate 32 (that is, the flow path unit 4) is bonded to the casing 2, the compliance portion 46 seals the recess 15. The compliance portion 46 absorbs the pressure variation of ink stored in the common ink reservoir 14. That is, the elastic film 43 is deformed in accordance with pressure of stored ink. Further, the above-described escaping recess portion 35 forms a space for allowing the elastic film 43 to be expanded.

The recording head 1 having the above-described constitution includes a common ink flow path from the ink supply needle 19 to the common ink reservoir 14, and an individual ink flow path reaching each of the nozzle orifices 48 by passing the pressure generating chamber 29 from the common ink reservoir 14. Further, ink stored in the ink cartridge is introduced from the ink supply needle 19 and stored in the common ink reservoir 14 by passing the common ink flow path. Ink stored in the common ink reservoir 14 is ejected from the nozzle orifice 48 by passing the individual ink flow path.

For example, when the piezoelectric vibrator 10 is contracted, the diaphragm portion 44 is pulled to the side of the vibrator unit 3 to expand the pressure generating chamber 29. By the expansion, inside of the pressure generating chamber 29 is brought under negative pressure, ink at inside of the common ink reservoir 14 flows into each pressure generating chamber 29 by passing the ink supply port 45. Thereafter, when the piezoelectric vibrator 10 is extended, the diaphragm portion 44 is pushed to the side of the chamber formation plate 30 to contract the pressure generating chamber 29. By the contraction, ink pressure at inside of the pressure generating chamber 29 rises and an ink drop is ejected from the corresponding nozzle orifice 48.

According to the recording head 1, the bottom face of the pressure generating chamber 29 (elongated recess portion 33) is recessed in the V-shaped shape. Therefore, the wall thickness of the proximal portion of the partition wall 28 for partitioning the contiguous pressure generating chambers 29 is formed to be thicker than the wall thickness of the distal end portion. Thereby, the rigidity of the thick wall 28 can be increased. Therefore, in ejecting an ink drop, even when a variation of ink pressure is produced at inside of the pressure generating chamber 29, the pressure variation can be made to be difficult to transmit to the contiguous pressure generating chamber 29. As a result, the so-called contiguous cross talk can be prevented and ejection of ink drop can be stabilized.

According to the embodiment, the ink supply port 45 for communicating the common ink reservoir 14 and the pressure generating chamber 29 is constituted by the small hole penetrating the elastic plate 32 in the plate thickness direction, high dimensional accuracy thereof is easily achieved by laser machining or the like. Thereby, an ink flowing characteristic into the respective pressure generating chambers 29 (flowing velocity, flowing amount or the like) can be highly equalized. Further, when the fabrication is carried out by the laser beam, the fabrication is also facilitated.

According to the embodiment, there are provided the dummy pressure generating chambers which are not related to ejection of ink drop contiguously to the pressure generating chambers 29 at end portions of the row (that is, a hollow portion partitioned by the dummy recess portion 36 and the elastic plate 32), with regard to the pressure generating chambers 29 at both ends, one side thereof is formed with the contiguous pressure generating chamber 29 and an opposed thereof is formed with the dummy pressure generating chamber. Thereby, with regard to the pressure generating chambers 29 at end portions of the row, the rigidity of the partition wall partitioning the pressure generating chamber 29 can be made to be equal to the rigidity of the partition wall at the other pressure generating chambers 29 at a middle of the row. As a result, ink drop ejection characteristics of all the pressure generating chambers 29 of the one row can be made to be equal to each other.

With regard to the dummy pressure generating chamber, the width on the side of the aligning direction is made to be wider than the width of the respective pressure generating chambers 29. In other words, the width of the dummy recess portion 36 is made to be wider than the width of the elongated recess portion 33. Thereby, ejection characteristics of the pressure generating chamber 29 at the end portion of the row and the pressure generating chamber 29 at the middle of the row can be made to be equal to each other with high accuracy.

According to the embodiment, the recess 15 is formed by partially recessing the front end face of the casing 2, the common ink reservoir 14 is formed to partition by the recess 15 and the elastic plate 32, an exclusive member for forming the common ink reservoir 14 is dispensed with and simplification of the constitution is achieved. Further, the casing 2 is fabricated by resin dieing, fabrication of the recess 15 is also relatively facilitated.

Next, a method of manufacturing the recording head 1 will be explained. Since the manufacturing method is characterized in steps of manufacturing the chamber formation plate 30, an explanation will be mainly given for the steps of manufacturing the chamber formation plate 30.

The chamber formation plate 30 is fabricated by forging by a progressive die. Further, a metal strip 55 (referred to as "strip 55" in the following explanation) used as a material of the chamber formation plate 30 is made of nickel as described above.

The steps of manufacturing the chamber formation plate 30 comprises steps of forming the elongated recess portion 33 and steps of forming the communicating port 34 which are carried out by a progressive die.

Figure 8A:
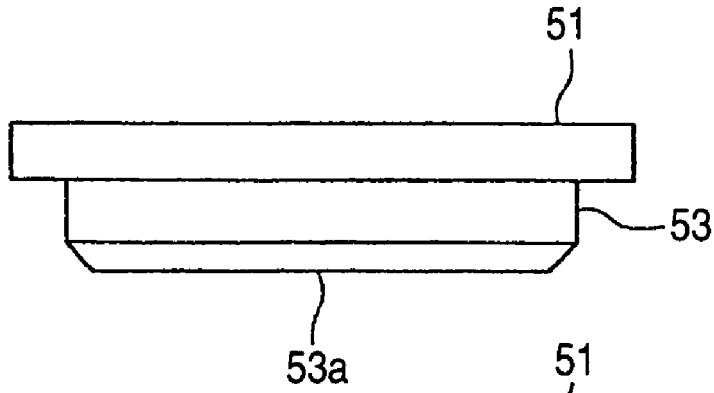
FIGS. 8A and 8B are views for explaining a first die used in forming an elongated recess portion.
Figure 8B:
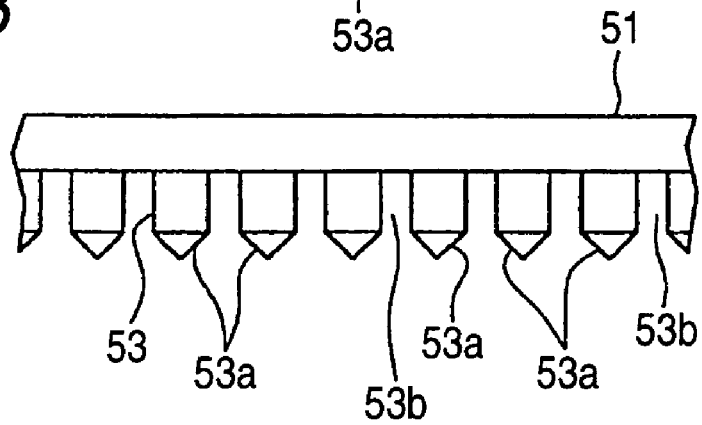
Figure 9A:
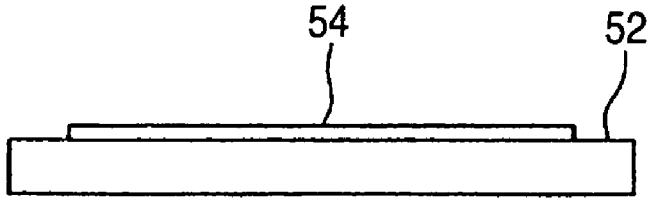
FIGS. 9A and 9B are views for explaining a second die used in forming the elongated recess portion.
Figure 9B:
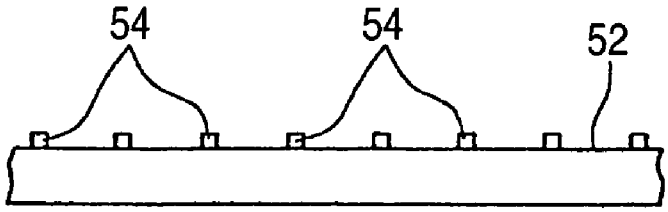

In the elongated recess portion forming steps, a male die 51 shown in FIGS. 8A and 8B and a female die shown in FIGS. 9A and 9B are used. The male die 51 is a die for forming the elongated recess portion 33. The male die is aligned with projections 53 for forming the elongated recess portions 33 by a number the same as that of the elongated recess portions 33. Further, the projections 53 at both ends in an aligned direction are also provided with dummy projections (not illustrated) for forming the dummy recess portions 36. A distal end portion 53*a* of the projection 53 is tapered from a center thereof in a width direction by an angle of about 45 degrees as shown in FIG. 8B. Thereby, the distal end portion 53*a* is sharpened in the V-shaped shape in view from a longitudinal direction thereof. Further, both longitudinal ends of the distal end portions 53A are tapered by an angle of about 45 degrees as shown in FIG. 8A. Therefore, the distal end portion 53*a* of the projection 53 is formed in a shape of tapering both ends of a triangular prism.

Further, the female die 52 is formed with a plurality of projections 54 at an upper face thereof. The projection 54 is for assisting to form the partition wall partitioning the contiguous pressure generating chambers 29 and is disposed between the elongated recess portions 33. The projection 54 is of a quadrangular prism, a width thereof is set to be a slight narrower than an interval between the contiguous pressure generating chambers 29 (thickness of partition wall) and a height thereof is set to a degree the same as that of the width. A length of the projection 54 is set to a degree the same as that of a length of the elongated recess portion 33 (projection 53).

Figure 10A:
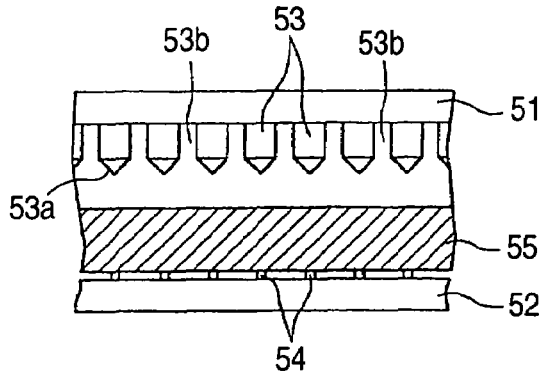
FIGS. 10A to 10C are views for explaining steps of forming the elongated recess portion.
Figure 10B:
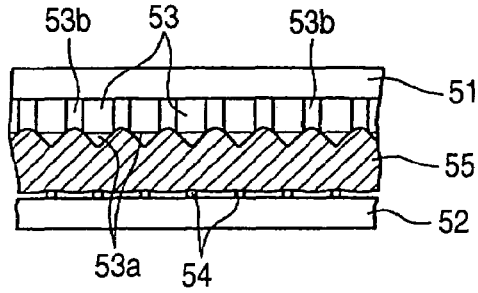
Figure 10C:
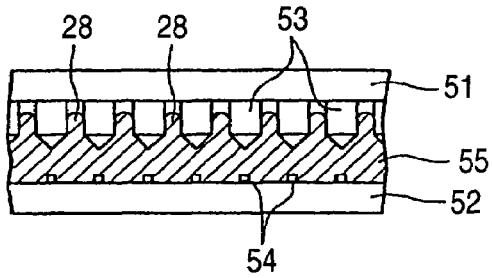
Figure 10D:
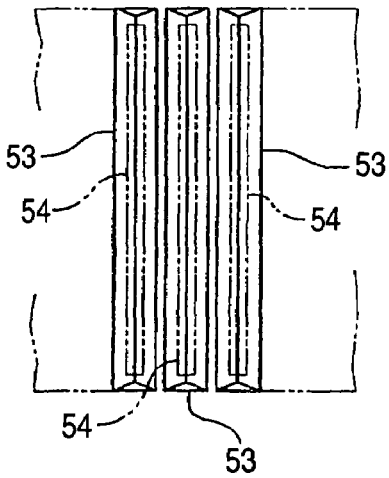
FIG. 10D is a plan view for explaining a positional relationship between the first die and the second die.

In the elongated recess portion forming steps, first, as shown in FIG. 10A, the strip 55 is mounted at an upper face of the female die 52 and the male die 51 is arranged on an upper side of the strip 55. Next, as shown in FIG. 10B, the male die 51 is moved down to push the distal end portion of the projection 53 into the strip 55. At this occasion, since the distal end portion 53*a* of the projection 53 is sharpened in the V-shaped shape, the distal end portion 53*a* can firmly be pushed into the strip 55 without buckling. Pushing of the projection 53 is carried out up to a middle in a plate thickness direction of the strip 55 as shown in FIG. 10C.

By pushing the projection 53, a portion of the strip 55 flows to form the elongated recess portion 33. In this case, since the distal end portion 53*a* of the projection 53 is sharpened in the V-shaped shape, even the elongated recess portion 33 having a small shape can be formed with high dimensional accuracy. That is, the portion of the strip 55 pushed by the distal end portion 53*a* flows smoothly, the elongated recess portion 33 to be formed is formed in a shape following the shape of the projection 53. Further, since the both longitudinal ends of the distal end portion 53*a* are tapered, the strip 55 pushed by the portions also flows smoothly. Therefore, also the both end portions in the longitudinal direction of the elongated recess portion 33 are formed with high dimensional accuracy.

Since pushing of the projection 53 is stopped at the middle of the plate thickness direction, the strip 55 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the strip 55 is raised into a space between the contiguous projections 53 by being pressed by the projections 53. In this case, the projection 54 provided at the female die 52 is arranged at a position in correspondence with an interval between the projections 53, flow of the strip 55 into the space is assisted. Thereby, the strip 55 can efficiently be introduced into the space between the projections 53 and the protrusion (i.e., the partition wall 28) can be formed highly.

Figure 11:
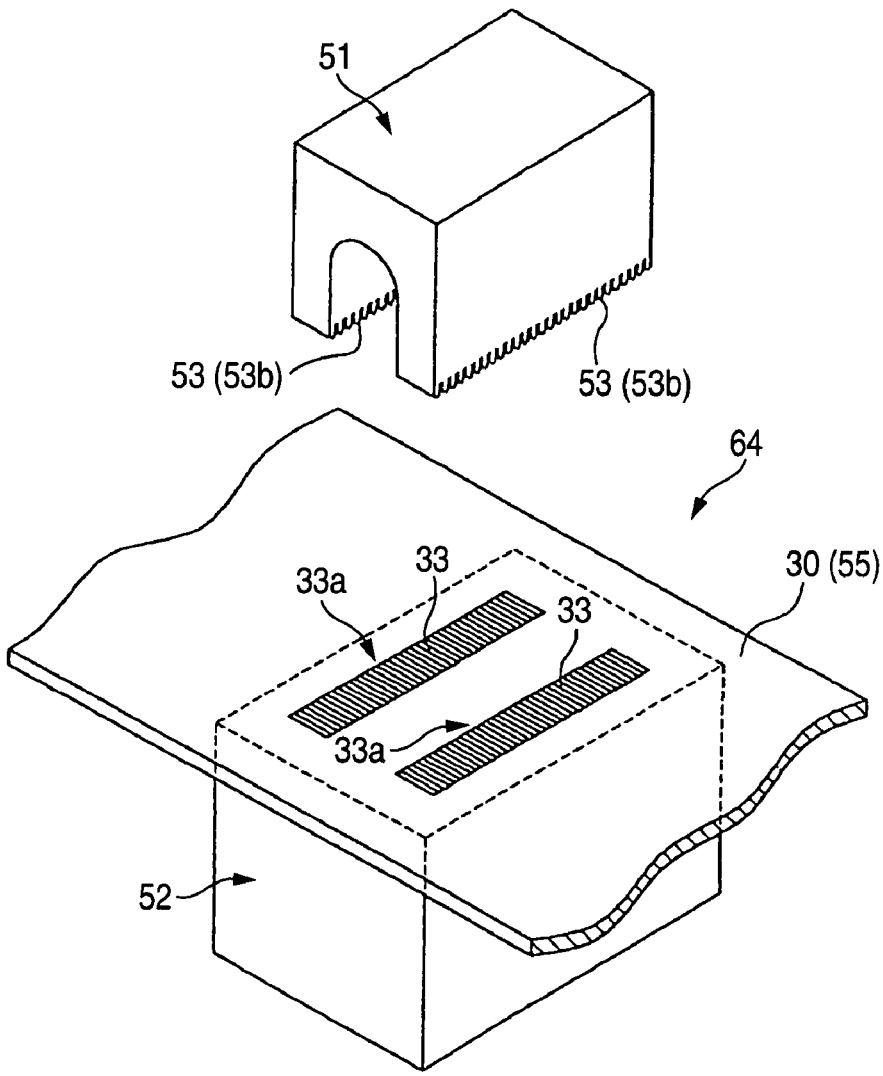
FIG. 11 is a perspective view showing positional relationships between the first die, a material plate, and the second die.

FIG. 11 shows positional relationships between the first die 51, the second die 52, the material plate 55. The elongated recess portions 33 are arrayed to form two arrays 33*a* of the elongated recess portions 33.

The above-described plastic working on a strip (material plate) 55 using the first die 51 and the second die 52 is performed at ordinary temperature. Likewise, plastic working that will be described below is performed at ordinary temperature.

Figure 12:
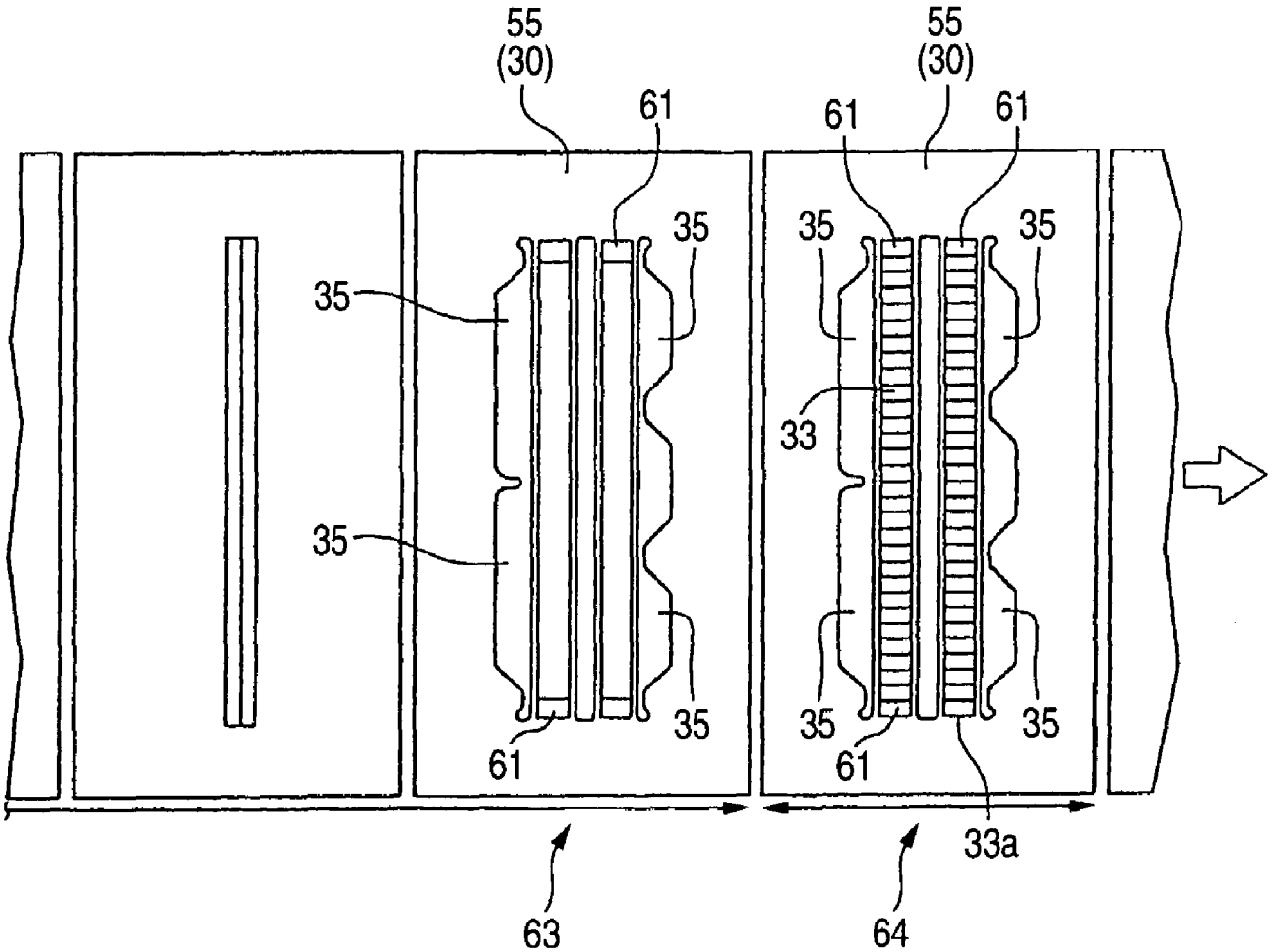
FIG. 12 is a plan view showing how the forging works proceed.

FIG. 12 shows how a material plate 55 is moved in a progressive forging apparatus. The material plate 55 is progressively transferred rightward in this figure. In a preforming process 63, various kinds of boring, recess formation, etc. are performed on the nickel material plate 55. Typical structures formed are the escaping recess portions 35 and opening portions 61 (through holes). The elongated recess portions 33 are formed by a main process 64 that is executed after the preforming process 63. In the preforming process 63, either the escaping recess portions 35 or the opening portions 61 may be formed first.

Figure 14:
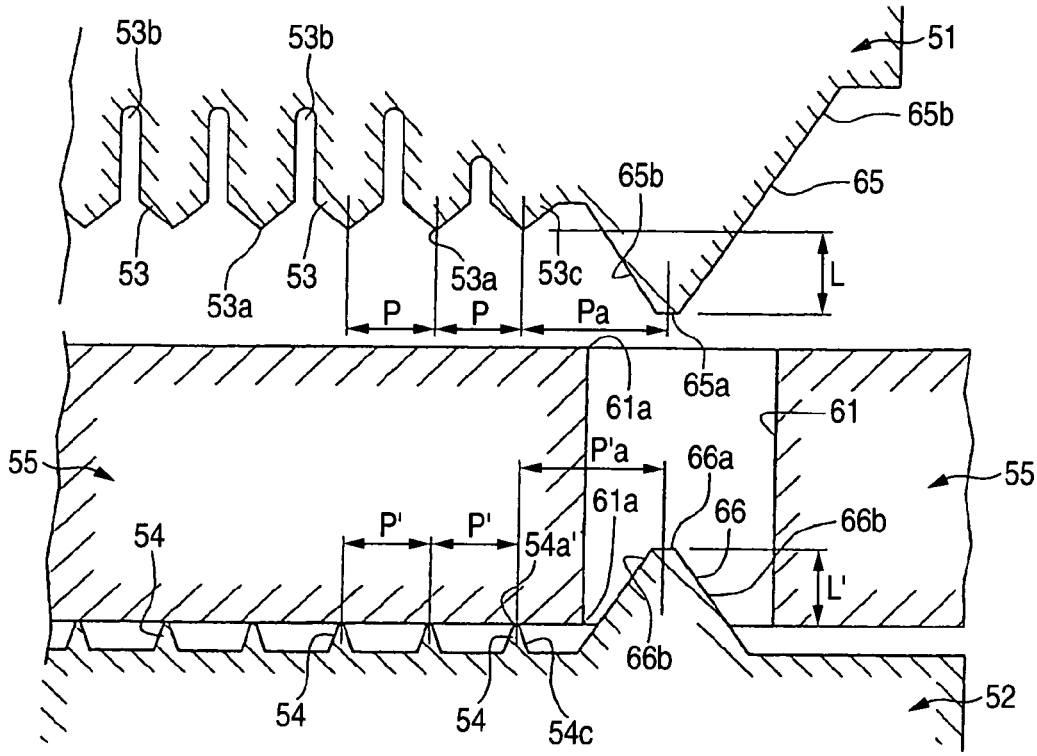
FIG. 14 is a sectional view of dam members and the material plate according to a first embodiment of the invention, showing a state before the first die is pressed against the material plate.

FIG. 14 shows a state that the material plate 55 is placed on the second die 52 and the first die 51 stands by over the material plate 55.

One of the projections 53 situated in the end of the projection array is referred as an "array-end projection 53*c*". The expression "in the vicinity of the array-end projection 53*c*" is used to refer to a position that is a little distant outward from the array-end projection 53*c*, in other words, from the end of array of the projections 53. A dam member 65 is provided in the vicinity of the array-end projection 53*c* so as to extend parallel with the projections 53. A tip end 65*a* of the dam member 65 is lower than tip ends 53*a* of the projections 53 by a dimension L. An interval Pa between the array-end projection 53*c* and the dam member 65 is equal to or a little shorter than about two times a pitch P of the projections 53.

The dam member 65 has a wedge-shaped sectional shape: two flat slant faces 65*b* extend perpendicularly to the paper surface of this figure. The flat slant faces 65*b* that form the wedge-shaped shape may be replaced by concave slant faces or convex slant faces in view of a plastic flow amount of the material (described later).

The dam member 65 is integral with the first die 51. On the other hand, a dam member 66 having a similar shape is provided on the second die 52 so as to oppose to the dam member 65. One of the projections 54 situated in the end of the projection array is referred as an "array-end projection 54*c*". The expression "in the vicinity of the array-end projection 54*c*" is used to refer to a position that is a little distant outward from the array-end projection 54*c*, in other words, the end of arrangement of the projections 54. The dam member 66 is provided in the vicinity of the array-end projection 54*c* so as to extend parallel with the projections 54. A tip end 66*a* of the dam member 66 is higher than tip ends 54*a* of the projections 54 by a dimension L'. An interval Pa' between the array-end projection 54*c* and the dam member 66 is equal to or a little shorter than about two times a pitch P' of the projections 54.

Therefore, the dam member 66 which is provided on the second die 52 is located at the position corresponding to the position in the vicinity of the array-end projection 53*c* so as to extend parallel with the projections 53 (53*c*). The dam member 66 projects toward the first die 51 (i.e., the tip end 66*a* is closer to the first die 51 than the other portions of the second die 52 are). Since as described above the projections 53 and the projections 54 are opposed to each other, their pitches P and P' are the same. Further, since the dam members 65 and 66 are approximately opposed to each other, the intervals Pa and Pa' are also the same.

The dam member 66 shown in FIG. 14 has a wedge-shaped sectional shape: two flat slant faces 66*b* extend perpendicularly to the paper surface of this figure. The flat slant faces 65*b* that form the wedge-shaped shape may be replaced by concave slant faces or convex slant faces in view of the plastic flow amount of the material (described later).

Figure 15:
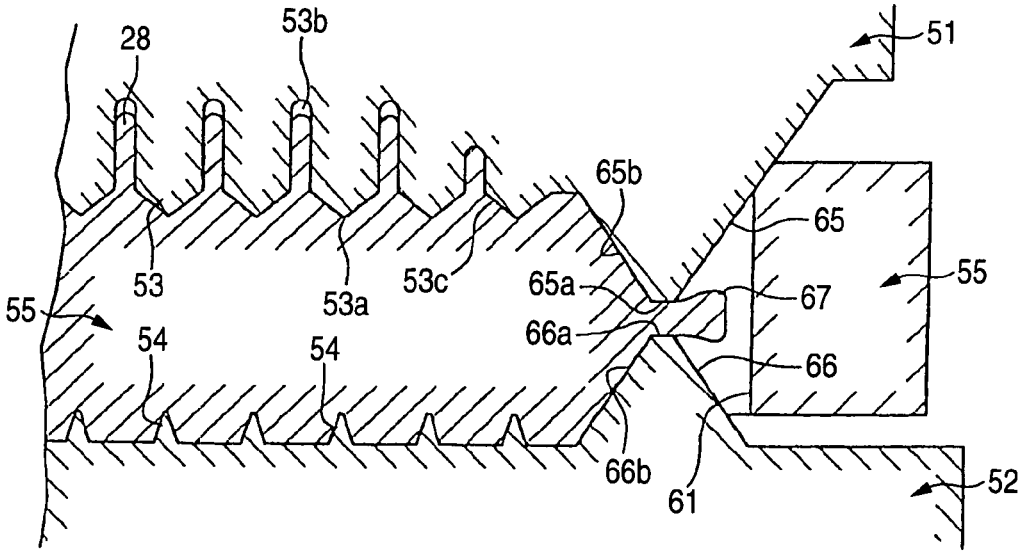
FIG. 15 is a sectional view of the dam members and the material plate of FIG. 14, showing a state after the first die is pressed against the material plate.

In a state that pressing on the material plate 55 has completed, the tip ends 65*a* and 66*a* of the dam members 65 and 66 are close to each other as shown in FIG. 15.

Figure 13:
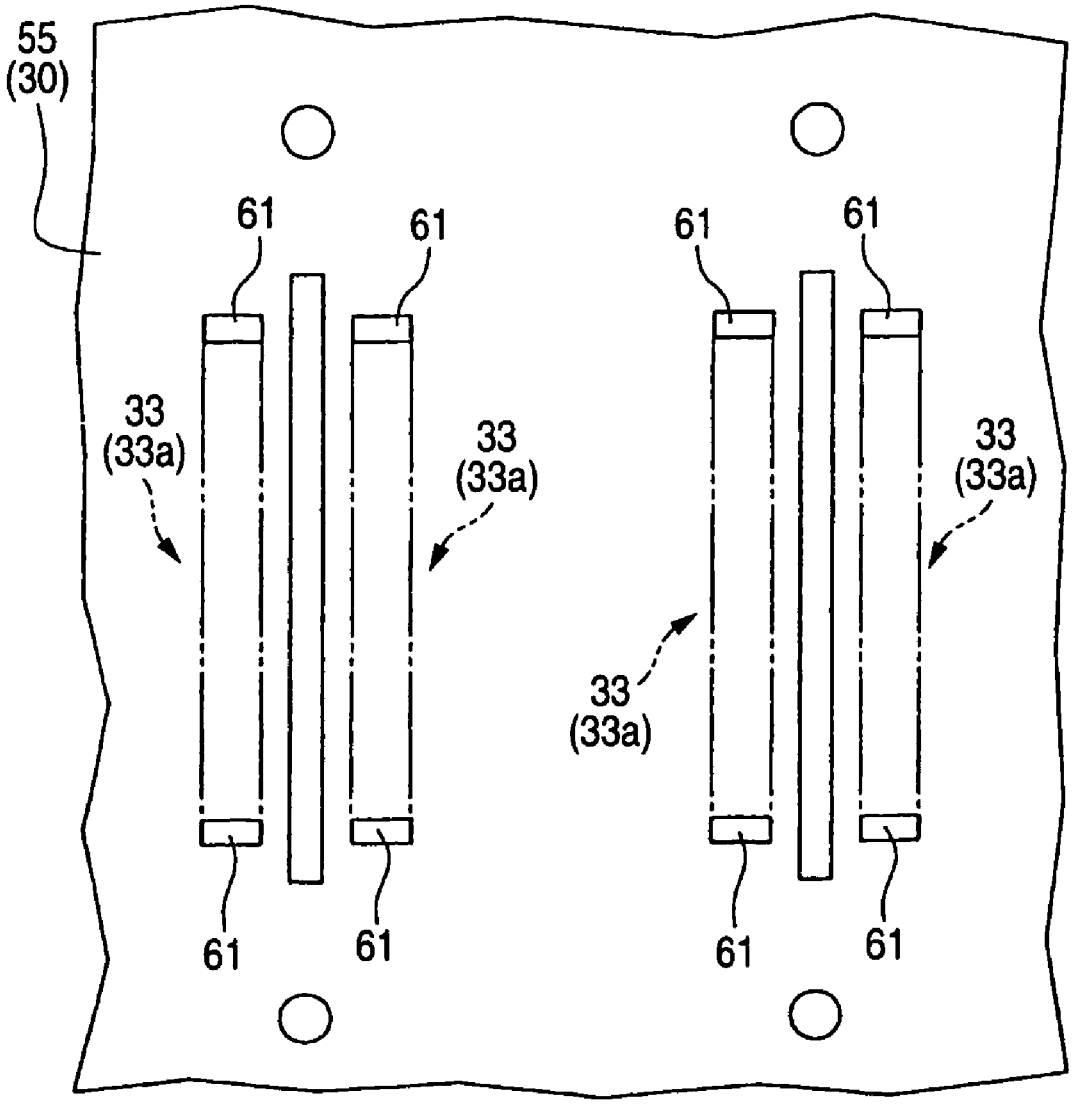
FIG. 13 is an enlarged plan view showing a part where the elongated recess portions are formed.

The above-mentioned opening portion 61 is provided to form a space for accepting the dam members 65 and 66. In this embodiment, the opening portion 61 penetrates through the material plate 55 and takes the form of a rectangle whose long sides are approximately the same in length as the elongated recess portions 33 (see FIG. 13). The size and the position of the opening portion 61 are set so that a part of the dam member 66 enters the opening portion 61 when a material plate 55 is placed on the second die 52. The opening portion 61 is located in the vicinity of the end of the array 33*a* of elongated recess portions 33 and is extended in parallel with the longitudinal direction of the elongated recess portions 33.

In this embodiment, the opening portion 61 is located adjacent to the array 33*a* of elongated recess portions 33. That is, the opening portion 61 is located in the vicinity of an "array-end" pressure generating chamber 29. Since the opening portion 61 is located at such a position, the dam members 65 and 66 suppress a plastic flow of the material at the position closest to the elongated recess portions 33, whereby the stress that is concentrated on the base portions of projections 53 can be reduced considerably, as explained below.

When the first die 51 is advanced from the state of FIG. 14, the slant face 65*b* of dam member 65 is pressed against a top edge 61*a* of the opening portion 61. As the first die 51 is advanced further, the top edge 61*a* is deformed so as to be crushed by the slant face 65*b*. When the top edge 61*a* is pressed and deformed, the projections 53 start to press the material plate 55 and hence the projections 54 start to dig into the bottom surface of the material plate 55. The slant face 66*b* deforms a bottom edge 61*a* so as to crush it. After the top and bottom edges 61 a have been crushed by the slant faces 65*b* and 66*b*, a plastic flow of the material of the material plate 55 going outward away from the array-end projection 53*c* starts to be suppressed. Since the projections 53 are dug into the material plate 55 in this state, a plastic deformation due to the digging of the projections 53 is suppressed by the dam members 65 and 66.

As shown in FIG. 15, in a state that the material plate 55 has been pressed completely, the edges 61*a* have been deformed greatly by the slant faces 65*b* and 66*b*. Because of a resulting plastic deformation, the space between the array-end projections 53*c*, 54*c* and the dam members 65, 66 is filled with the material. An excess material is pressed between the tip ends 65*a* and 66*a* that are close to each other and becomes an outflow portion 67.

Figure 20:
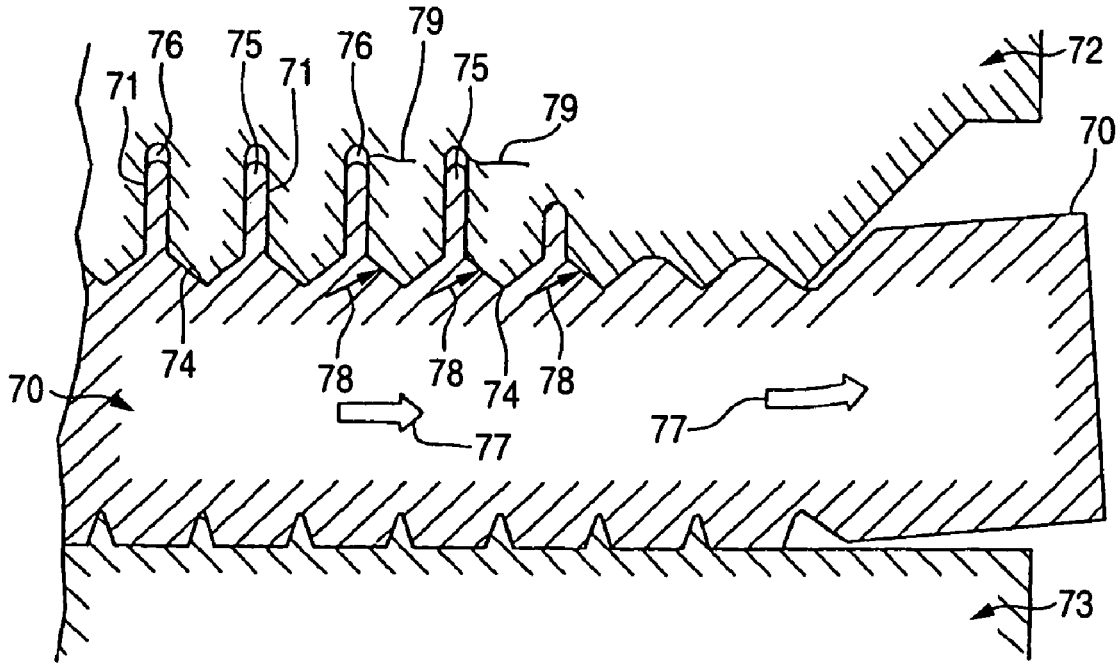
FIG. 20 is a sectional view showing relationships between a first die, a material plate, and a second die after pressing in a conventional configuration.

When the edge portions 61*a* are deformed so as to be crushed by the slant faces 65*b* and 66*b*, the material of a central part, in the thickness direction, of the material plate 55 receives force that causes it to flow toward the projections 53 and the projections 54 (i.e., leftward in FIG. 14). However, the stress component of a flow toward the dam members 65 and 66 due to the digging of the projections 53 is opposed to and balanced with the stress component of the flow toward the projections 53 and the projections 54, whereby such a plastic flow in the direction indicated by arrow 77 in FIG. 20 is suppressed.

As described the above, the interval Pa and Pa' is equal to or a little shorter than about two times the pitch P and P'. However, the interval Pa and Pa' may be set in a range of about three times to about five times the pitch P and P in accordance with a variation in the plastic flow amount of the material or the flow phenomenon that occurs when the thickness of the material plate 55, the depth of elongated recess portions 33 formed, the opening area of the opening portion 61, the inclination angle of the slant faces 65*b* and 66*b* of the dam members 65 and 66, or some other factors. Setting the interval Pa and Pa' in such a range makes it possible to suppress a plastic flow effectively and elongate the life of the dies even if any of the above various dimensions etc. is changed.

In FIG. 15, the space on the left of the dam members 65 and 66 is filled with the material. However, a void may be formed between the material and the slant faces 65*b* and 66*b* if the interval Pa and Pa' is increased, the projection lengths L and L' are changed, or the thickness of the material plate 55 is changed.

If the projection lengths L and L' of the dam members 65 and 66 are set too short, the projections 53 start to dig into the material plate 55 before the suppression function of the dam members 65 and 66 takes effect completely. Further, in the initial stage of the digging of the projections 53, almost no plastic flow occurs. Therefore, it is important to determine the length L and L' of the dam members 65 and 66 such that the suppression function of the dam members 65 and 66 to takes effect fully when the projections 53 have dug to some extent and a plastic flow has occurred. That is, the timing between the suppression operation of the dam members 65 and 66 and the digging operation of the projections 53 is set properly so that the suppression function takes effect correctly. If the length L and L' of the dam members 65 and 66 are as short as possible while taking the above into consideration it is possible to shorten the pressing stroke of the dies and thereby increase the productivity.

There will be listed advantages obtained by the above configuration.

Since the dam members 65 and 66 suppress a plastic flow in the arrayed direction of the projections 53 and 54, stress produced by the plastic flow and acting on the tip ends of projections 53 are weakened greatly. As a result, no cracks develop at the base portions of the projections 53. Therefore, the life of the first die 51 is elongated, the working quality of the material plate 55 is stabilized, the equipment costs are reduced, the productivity is increased, and like advantages are obtained.

As the first die 51 and the second die 52 approach each other, the dam members 65 and 66 of the first die 51 and the second die 52 are first moved to the positions where to stop a material flow in the material plate 55, whereby a state of stopping (damming up) a plastic flow in the projections arrangement direction is established. After then, the projections 53 are dug into the material plate 55 and elongated recess portions 33 are formed. Therefore, even if the material receives force that causes it to flow in the arrayed direction of the projections 53, 54 due to the digging of the projections 53, the dam member 65 prevents the material from flowing plastically. The disadvantageous forces (indicated by arrows 78 in FIG. 20) does not act on projections 53 and no stress is concentrated on the base portions of the projections 53.

Moreover, the space through which the stopped material is partially allowed to flow plastically is narrowed by the opposed dam members 65 and 66, which makes the suppressive function more reliable.

The opening portion 61 greatly reduces reaction forces that are produced when the dam members 65 and 66 are dug into the material plate 55. This makes it possible to easily have the dam members 65 and 66 located at the prescribed positions and to reliably allow the dam members 65 and 66 to stand by there for digging of the projections 53. Further, the opening portion 61 serves as a positioning member for the dam members 65 and 66.

Further, configuring the opening portion 61 as a through hole, the reaction forces can be made substantially zero, whereby the dam members 65 and 66 are reliably allowed to stand by for digging of the projections 53.

Figure 16:
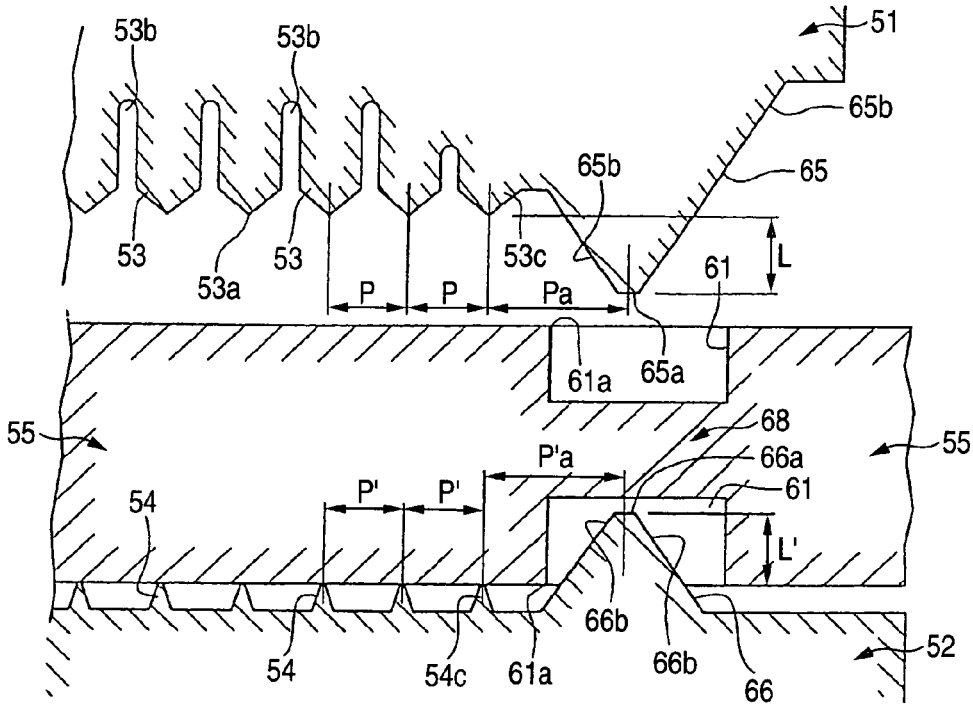
FIG. 16 is a sectional view of dam members and a material plate according to a second embodiment of the invention, showing a state before the first die is pressed against the material plate.

Next, a second embodiment of the invention will be described with reference to FIG. 16.

In this embodiment, the opening portions 61 are provided as bottomed holes partitioned by a partitioning member 68. The partitioning member 68 is pressed and deformed by the dam members 65 and 66, which is also effective in suppressing a plastic flow caused by the digging operation of the projections 53. Any others are the same as the first embodiment. Similar elements are designated by the same reference characters, and the repetitive explanations for those will be omitted.

Figure 17:
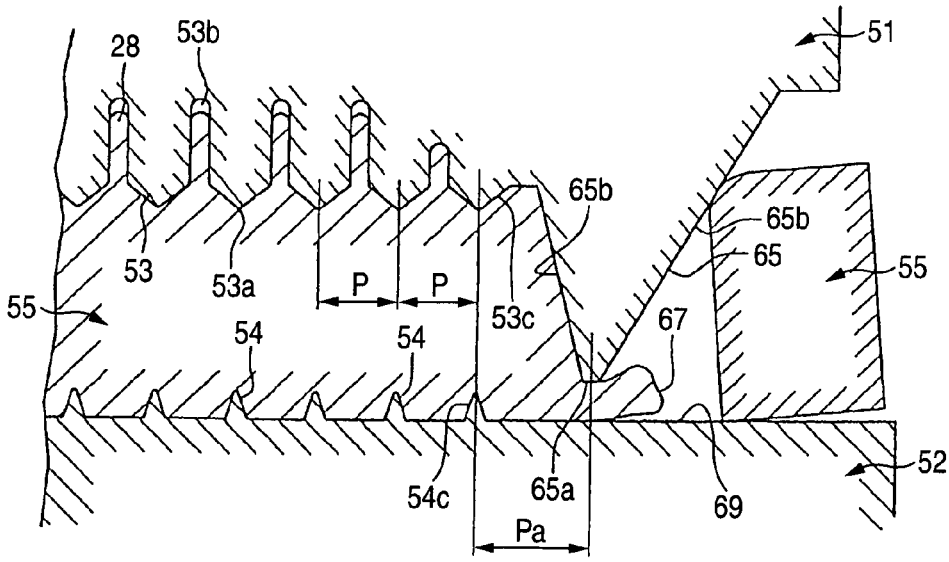
FIG. 17 is a sectional view of dam members and a material plate according to a third embodiment of the invention, showing a state before the first die is pressed against the material plate.

Next, a third embodiment of the invention will be described with reference to FIG. 17.

In this embodiment, only a dam member 65 is provided on the first die 51 and a tip end 65*a* of the dam member 65 is close to a surface portion 69 of the second die 52. Alternatively, only a dam member 66 may be provided on the second die 52 (this modification is not shown). Any others are the same as the first embodiment. Similar elements are designated by the same reference characters, and the repetitive explanations for those will be omitted.

As the first die 51 and the second die 52 approach each other, the dam member 65 of the first die 51 or the dam member 66 of the second die 52 is first moved to the position where to stop a material flow in the material plate 55, whereby a state of stopping (damming up) a plastic flow in the arrayed direction of projections 53, 54 is established. After then, the projections 53 are dug into the material plate 55 and elongated recess portions 33 are formed. Therefore, even if the material receives force that causes it to flow in the arrayed direction of the projections 53, 54 due to the digging of the projections 53, the dam member 65 prevents the material from flowing plastically. The disadvantageous forces (indicated by arrows 78 in FIG. 20) does not act on projections 53 and no stress is concentrated on the base portions of the projections 53.

In a liquid ejection head manufactured by any of the above embodiments, the opening portion 61 is provided in the vicinity of the "array-end" pressure generating chamber 29 of the chamber formation plate 30 so as to extend parallel with the elongated recess portions 33. Therefore, when the elongated recess portions 33 are formed in the material plate 55 by plastic working, the dam member(s) for suppressing an abnormal plastic flow can be inserted into the opening portion 61, whereby the elongated recess portions 33 can be formed with high accuracy. The opening portion 61 can be used for the positioning of the material plate 55, which is also effective in increasing the accuracy of the elongated recess portions 33.

Figure 18:
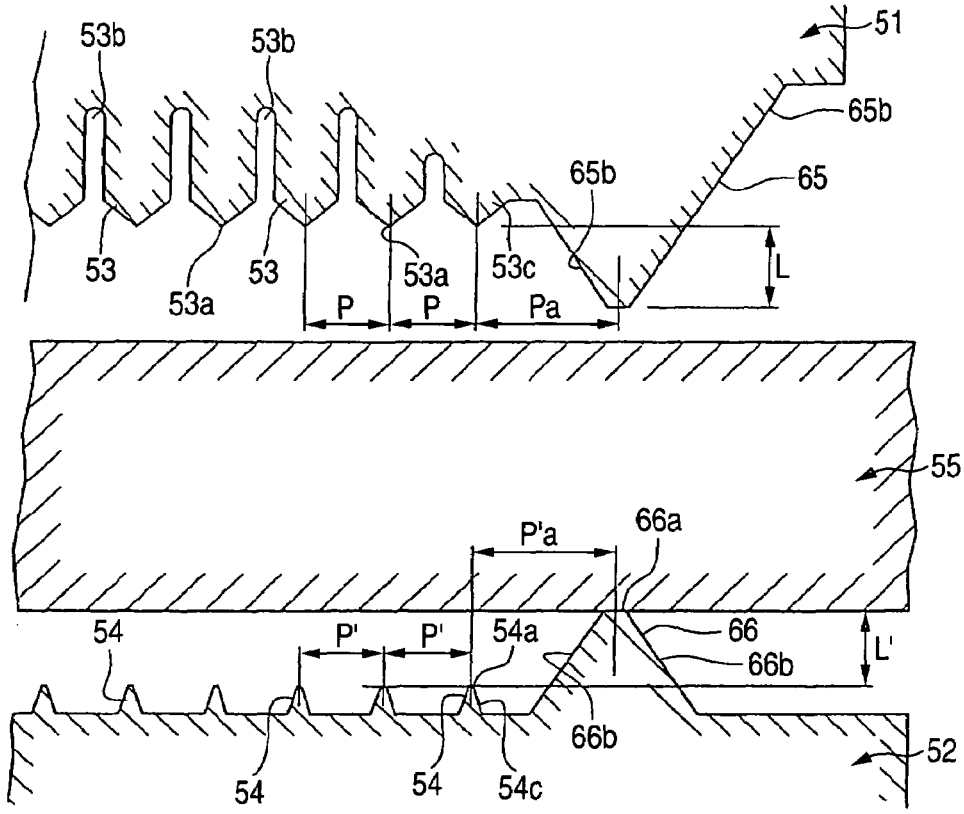
FIG. 18 is a sectional view of dam members and a material plate according to a fourth embodiment of the invention, showing a state before the first die is pressed against the material plate.
Figure 19:
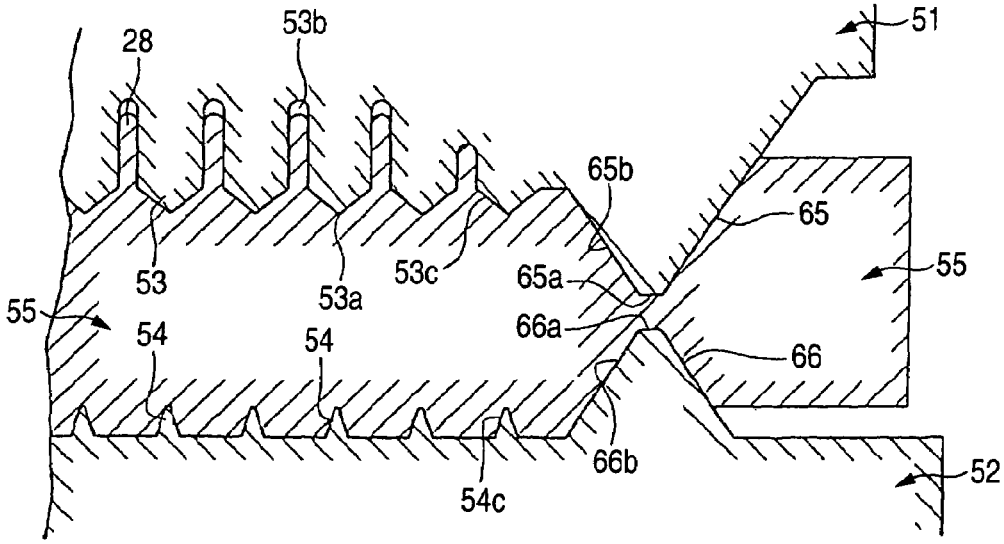
FIG. 19 is a sectional view of the dam members and the material plate of FIG. 18, showing a state after the first die is pressed against the material plate.

Next, a fourth embodiment of the invention will be described with reference to FIGS. 18 and 19.

In this embodiment, the above-described opening portion 61 is omitted. Any others are the same as the first embodiment. Similar elements are designated by the same reference characters, and the repetitive explanations for those will be omitted.

The dam members 65 and 66 are disposed so as to suppress a material flow when they are dug into the material plate 55 from both sides. Elongated recess portions 33 are formed by the projections 53 while the dam members 65 and 66 suppress a material flow caused by the projections 53. Since no opening portion 61 is provided, it is desirable that the projection lengths L and L' of the dam members 65 and 66 be decreased to reduce the amount of material flow due to the digging of the dam members 65 and 66 to thereby balance it with the amount of material flow due to the digging of the projections 53. Alternatively, such balancing may be attained by making the interval Pa and Pa' longer.

Figure 5B:
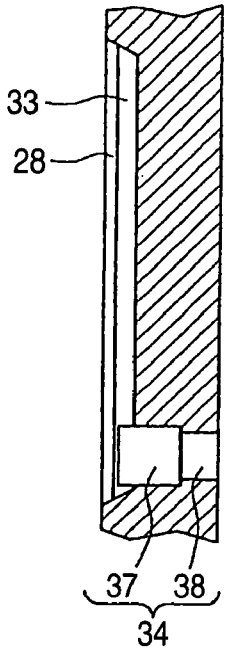
FIG. 5B is a sectional view taken along a line VB-VB of FIG. 5A.
Figure 5C:
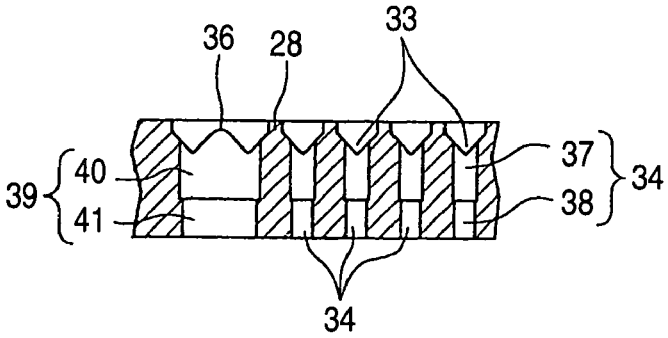
FIG. 5C is a sectional view taken along a line VC-VC of FIG. 5A.

After the forging work of the above embodiments is performed, the communicating ports 34 shown in FIG. 5 are formed in the elongated recess portions 33 that have been formed while a plastic flow in the material plate 55 is suppressed in the above-described manner. The communicating ports 34 are formed by inserting ordinary boring punches (not shown) into the elongated recess portions 33 and punching the material plate 55.

With the above method, the material does not exert pressing forces on projections 53 in the arrayed direction thereof, and hence the elongated recess portions 33 formed suffer from no such errors as inclinations from the depth direction thereof. Since the punches are inserted into those high-accuracy elongated recess portions 33, the punches do not interfere with the inner surfaces of the elongated recess portions 33 and the communicating ports 34 are formed at the correct positions with respect to the elongated recess portions 33. Ink flows smoothly as intended and stagnation of bubbles can be prevented.

Further, although according to the above-described embodiments, an example of applying the invention to the recording head used in the ink jet recording apparatus has been shown, an object of the liquid ejection head to which the invention is applied is not constituted only by ink of the ink jet recording apparatus but glue, manicure, conductive liquid (liquid metal) or the like can be ejected.

For example, the invention is applicable to a color filter manufacturing apparatus to be used for manufacturing a color filter of a liquid-crystal display. In this case, a coloring material ejection head of the apparatus is an example of the liquid ejection head. Another example of the liquid ejection apparatus is an electrode formation apparatus for forming electrodes, such as those of an organic EL display or those of a FED (Field Emission Display). In this case, an electrode material (a conductive paste) ejection head of the apparatus is an example of the liquid ejection head. Still another example of the liquid ejection apparatus is a biochip manufacturing apparatus for manufacturing a biochip. In this case, a bio-organic substance ejection head of the apparatus and a sample ejection head serving as a precision pipette correspond to examples of the liquid ejection head. The liquid ejection apparatus of the invention includes other industrial liquid ejection apparatuses of industrial application.

What is claimed is:

1. A method of manufacturing a liquid ejection head which ejects liquid droplets from nozzle orifices by generating pressure fluctuation in liquid contained in a plurality of pressure generating chambers communicated with the nozzle orifices, the method comprising:

providing a metallic plate member;

providing a first die, in which a plurality of projections are arrayed in a first direction with a fixed pitch, each of the projections being elongated in a second direction perpendicular to the first direction, the first die facing a first face of the plate member;

providing a second die, opposed to the first die while facing a second face of the plate member;

providing at least one dam member in at least one of the first die and the second die, so as to project from one of the first die and the second die toward the other one of the first die and the second die;

positioning the first die and the second die, so that the at least one dam member is dug into at least one of the first face and the second face of the plate member; and further the first die and the second die, so that the projections are dug into a first region in the first face of the plate member, the projections being pressed in a third direction orthogonal to the first direction and the second direction, so as to generate a plastic flow of a material in the plate member into gaps defined between the projections, thereby forming partitioned recesses, wherein the at least one dam member is situated in the vicinity of at least one of ends in the first direction of the first region, thereby suppressing a plastic flow of the material in the first direction caused by positioning of the projections, and wherein the plate member includes at least one opening formed in at least one of the first face and the second face and configured to accept the dam member.

2. The manufacturing method as set forth in claim 1, wherein the dam member is elongated in the second direction.

3. The manufacturing method as set forth in claim 1, wherein a tip end of the dam member is closer to the plate member than tip ends of the projections.

4. The manufacturing method as set forth in claim 1, wherein the at least one dam member is provided in each of the first die and the second die, such that the dam member in the first die and the dam member in the second die are opposed to each other.

5. The manufacturing method as set forth in claim 1 wherein the opening is formed in each of the first face and the second face.

6. The manufacturing method as set forth in claim 5, wherein the opening formed in the first face is communicated with the opening formed in the second face.

7. The manufacturing method as set forth in claim 5, wherein each of the opening formed in the first face and the opening formed in the second face is a bottomed hole.

8. The manufacturing method as set forth in claim 7, wherein the dam member is dug into a bottom portion of the bottomed hole.

9. The manufacturing method as set forth in claim 1, further comprising a step of boring a through hole at a bottom of each of the partitioned recesses, the through hole being to be a passage communicating one of the pressure chambers and one of the nozzle orifice.

* * * * *